US010611180B2

(12) United States Patent
Midorikawa et al.

(10) Patent No.: US 10,611,180 B2
(45) Date of Patent: Apr. 7, 2020

(54) LIQUID JET HEAD AND LIQUID JET RECORDING DEVICE

(71) Applicant: SII Printek Inc., Chiba-shi, Chiba (JP)

(72) Inventors: Masaru Midorikawa, Chiba (JP); Shunsuke Yamazaki, Chiba (JP); Naohiro Tomita, Chiba (JP); Shuji Sato, Chiba (JP); Yuki Yamamura, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/176,572

(22) Filed: Oct. 31, 2018

(65) Prior Publication Data

US 2019/0126649 A1 May 2, 2019

(30) Foreign Application Priority Data

Nov. 2, 2017 (JP) ..... 2017-212924

(51) Int. Cl.

| | |
|---|---|
| ***B41J 29/377*** | (2006.01) |
| ***B41J 2/175*** | (2006.01) |
| ***B41J 2/18*** | (2006.01) |
| ***B41J 29/13*** | (2006.01) |
| ***B41J 2/14*** | (2006.01) |

(52) U.S. Cl.

CPC ..... *B41J 29/377* (2013.01); *B41J 2/14209* (2013.01); *B41J 2/175* (2013.01); *B41J 2/17509* (2013.01); *B41J 2/18* (2013.01); *B41J 29/13* (2013.01); *B41J 2002/14362* (2013.01); *B41J 2202/08* (2013.01)

(58) Field of Classification Search

CPC .. B41J 2/04531; B41J 2/04538; B41J 2/0454; B41J 2/04553; B41J 2/04563; B41J 2/04565; B41J 2/14209; B41J 2/17509; B41J 2/18; B41J 2/1408; B41J 2002/14354; B41J 2002/14362; B41J 2202/08; B41J 29/377; B41J 29/13

See application file for complete search history.

(56) References Cited

U.S. PATENT DOCUMENTS

| | | | |
|---|---|---|---|
| 2015/0258791 | A1 | 9/2015 | Domae |
| 2017/0253048 | A1 | 9/2017 | Nishimura |

FOREIGN PATENT DOCUMENTS

| | | | |
|---|---|---|---|
| EP | 2921300 | A1 | 9/2015 |
| JP | 2015-171806 | A | 10/2015 |

OTHER PUBLICATIONS

Extended European Search Report in EP Application No. 18203129.4, dated Mar. 20, 2019, 11 pages.

*Primary Examiner* — Kristal Feggins
(74) *Attorney, Agent, or Firm* — Brinks Gilson & Lione

(57) ABSTRACT

There are provided a liquid jet head capable of dealing with jet of a variety of types of liquid, and at the same time superior in easiness in handling. The liquid jet head includes a main body part having a liquid jet head chip and a cooling section, and an inflow side connection unit and an outflow side connection unit each configured so as to selectively be attached to and detached from the main body part. As the inflow side connection unit, it is possible to select the first inflow side cover unit and the second inflow side cover unit. As the outflow side connection unit, it is possible to select the first outflow side cover unit and the second outflow side cover unit.

11 Claims, 18 Drawing Sheets

LIQUID JET HEAD AND LIQUID JET RECORDING DEVICE

RELATED APPLICATIONS

This application claims priority under 35 U.S.C. § 119 to Japanese Patent Application No. 2017-212924 filed Nov. 2, 2017, the entire content of which is hereby incorporated by reference.

BACKGROUND OF THE INVENTION

1. Field of the Invention

The present disclosure relates to a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on. In the liquid jet recording device of this type, it is arranged that the ink is supplied from an ink tank to an inkjet head (a liquid jet head), and then the ink is ejected from nozzles of the inkjet head toward the recording target medium to thereby perform recording of the images, the characters, and so on.

Further, such an inkjet head is provided with a head chip for ejecting the ink. Such a head chip and the driver integrated circuit (IC) for performing the drive control of the head chip involve heat generation when the inkjet head operates in some cases. Therefore, the applicant of the invention has already proposed the liquid jet head arranged to perform cooling of a control circuit including the driver IC by circulating the ink as a refrigerant (see JP-A-2015-171806).

The liquid jet head is capable of jetting a variety of types of liquid on the one hand, and is required to be easy to handle on the other hand. In other words, it is desired to provide a liquid jet head and a liquid jet recording device capable of dealing with jet of a variety of types of liquid, and at the same time superior in easiness in handling.

SUMMARY OF THE INVENTION

A liquid jet head according to an embodiment of the present disclosure is provided with a main body part, an inflow side connection unit and an outflow side connection unit. The main body part has a liquid jet head chip including a liquid flow channel through which a liquid passes, and adapted to jet the liquid, and a cooling section including a refrigerant flow channel through which a refrigerant passes. The inflow side connection unit is configured so as to be selectively attached to and detached from the main body part on an upstream side in the liquid flow channel and an upstream side in the refrigerant flow channel. The outflow side connection unit is configured so as to be selectively attached to and detached from the main body part on a downstream side in the liquid flow channel and a downstream side in the refrigerant flow channel.

Here, a first inflow side cover unit including a liquid inflow tube branched into a liquid relay path connectable to a liquid inflow port of the liquid flow channel and a refrigerant relay path connectable to a refrigerant inflow port of the refrigerant flow channel, and a second inflow side cover unit separately including a liquid inflow tube connected to the liquid relay path connectable to the liquid inflow port and a refrigerant inflow tube connected to the refrigerant relay path connectable to the refrigerant inflow port of the refrigerant flow channel are selectable as the inflow side connection unit.

On the other hand, a first outflow side cover unit including a liquid outflow tube where a liquid relay path connectable to a liquid outflow port of the liquid flow channel and a refrigerant relay path connectable to a refrigerant outflow port of the refrigerant flow channel are merged with each other, and a second outflow side cover unit separately including a liquid outflow tube connected to the liquid relay path connectable to the liquid outflow port and a refrigerant outflow tube connected to the refrigerant relay path connectable to the refrigerant outflow port of the refrigerant flow channel are selectable as the outflow side connection unit.

A liquid jet recording device according to an embodiment of the present disclosure is equipped with the liquid jet head according to an embodiment of the present disclosure, and a carriage to which the liquid jet head is attached.

According to the liquid jet head and the liquid jet recording device related to the embodiment of the present disclosure, it is possible to deal with the jet of a variety of types of liquid, and at the same time, the excellent handling can be ensured.

DETAILED DESCRIPTION OF THE PREFERRED EMBODIMENTS

An embodiment of the present disclosure will hereinafter be described in detail with reference to the drawings.

1. Embodiment

[Overall Configuration of Printer 1]

Figure 1:
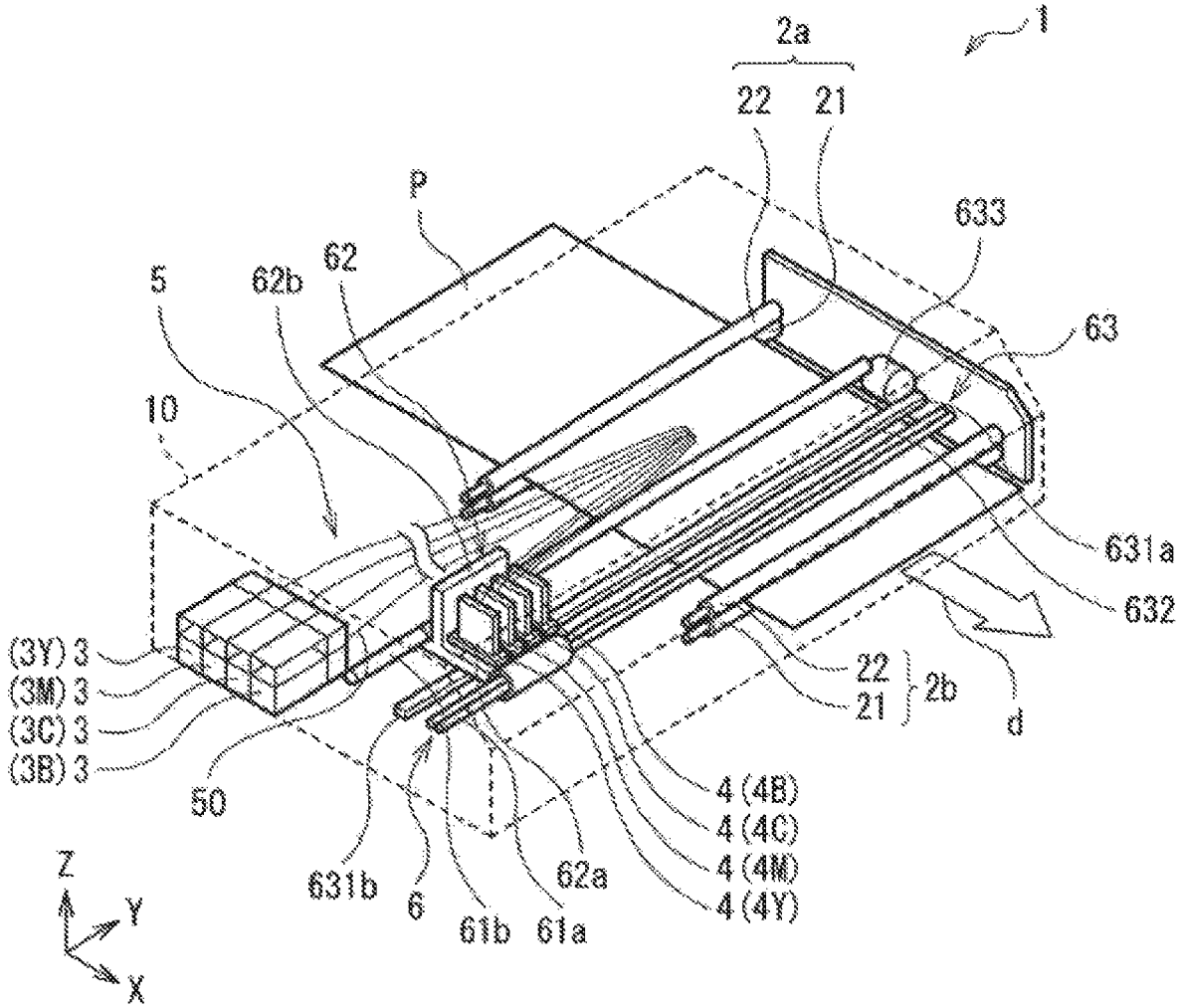
FIG. 1 is a schematic perspective view showing a schematic configuration example of a liquid jet recording device according to an embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification. Further, in the present specification, the description will be presented assuming a Z-axis direction shown in FIG. 1 as a vertical direction. In detail, the description will be presented assuming a +Z direction as an upward vertical direction, and a −Z direction as a downward vertical direction.

Here, the printer 1 corresponds to a specific example of the "liquid jet recording device" in the present disclosure, and the inkjet heads 4 (the inkjet heads 4Y, 4M, 4C, and 4B described later) each correspond to a specific example of the "liquid jet head" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink inside. As the ink tanks 3, there are disposed 4 types of tanks for individually containing 4 colors of ink, namely yellow (Y), magenta (M), cyan (C), and black (B), in this example as shown in FIG. 1. Specifically, there are disposed the ink tank 3Y for containing the yellow ink, the ink tank 3M for containing the magenta ink, the ink tank 3C for containing the cyan ink, and the ink tank 3B for containing the black ink. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink contained, and are therefore collectively referred to as ink tanks 3 in the following description.

(Inkjet Heads 4)

The inkjet heads 4 are each a head for jetting (ejecting) the ink having a droplet shape from a plurality of nozzles H1, H2 described later to the recording paper P to thereby perform printing of images, characters, and so on. As the inkjet heads 4, there are disposed 4 types of heads for individually jetting the 4 colors of ink respectively contained by the ink tanks 3Y, 3M, 3C, and 3B described above in this example as shown in FIG. 1. Specifically, there are disposed the inkjet head 4Y for jetting the yellow ink, the inkjet head 4M for jetting the magenta ink, the inkjet head 4C for jetting the cyan ink, and the inkjet head 4B for jetting the black ink. These inkjet heads 4Y, 4M, 4C, and 4B are arranged side by side along the Y-axis direction inside the housing 10.

It should be noted that the inkjet heads 4Y, 4M, 4C, and 4B have the same configuration except the color of the ink used, and are therefore collectively referred to as inkjet heads 4 in the following description. Further, the detailed configuration of the inkjet heads 4 will be described later in detail.

(Circulation Mechanism 5)

The circulation mechanism 5 is configured including ink circulation channels 50 for circulating the ink between the ink tanks 3 and the head chips 403 (described later) included in the inkjet heads 4, and a refrigerant circulation channel 55 for circulating the refrigerant between a refrigerant tank 7 and cooling sections 404 (described later) included in the inkjet heads 4. It should be noted that the detailed configuration of the circulation mechanism 5 will be described later (see FIGS. 2A and 2B described later).

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is connected the carriage 62. The carriage 62 has a pedestal 62*a* having a plate-like shape for mounting the four types of inkjet heads 4Y, 4M, 4C, and 4B described above, and a wall section 62*b* erected vertically (in the Z-axis direction) from the pedestal 62*a*. On the pedestal 62*a*, the inkjet heads 4Y, 4M, 4C, and 4B are arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Circulation Mechanism 5]

Figure 2A:
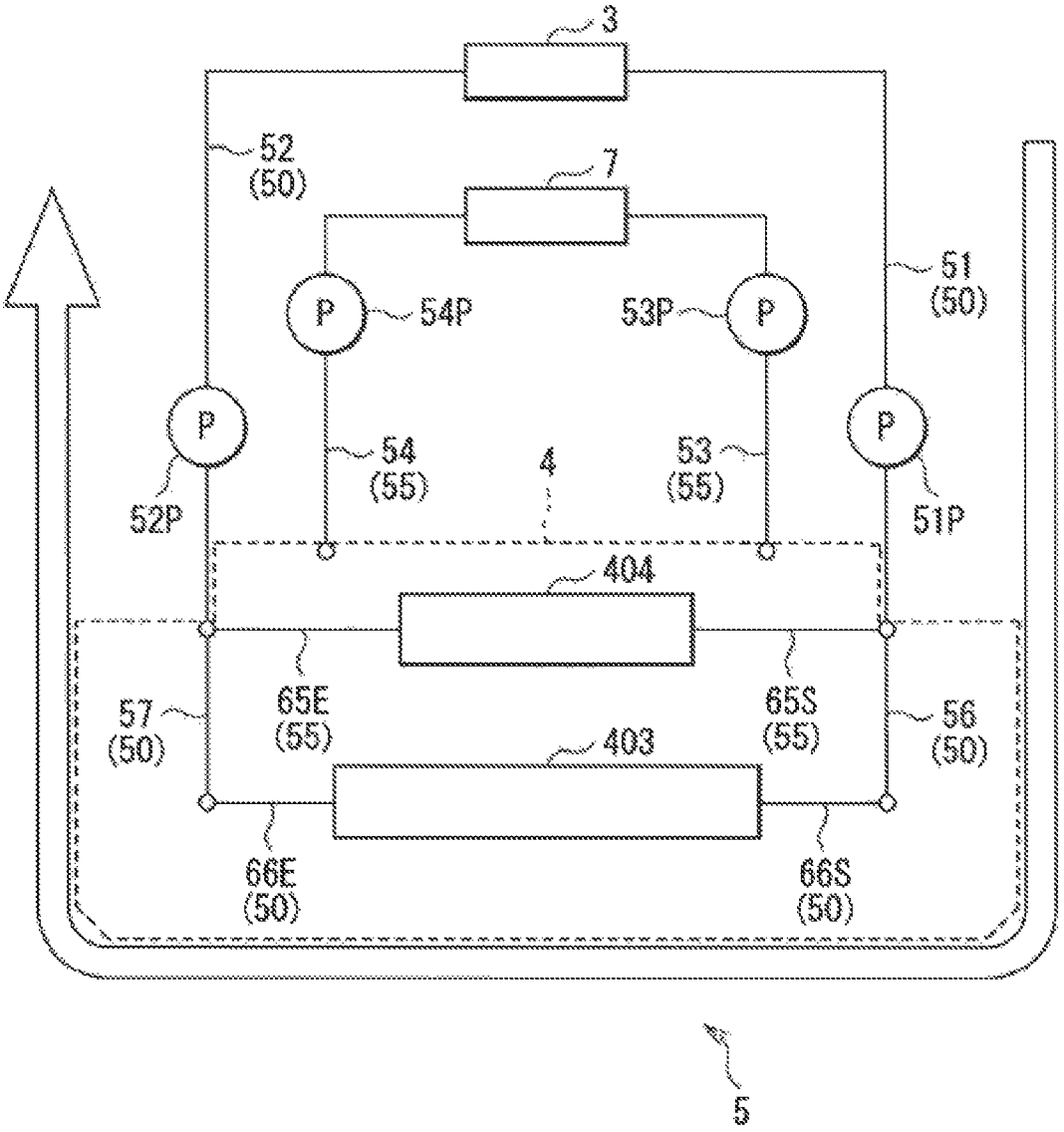
FIG. 2A is a schematic diagram showing a schematic configuration example of a circulation mechanism in a first mode of the jet recording device shown in FIG. 1.
Figure 2B:
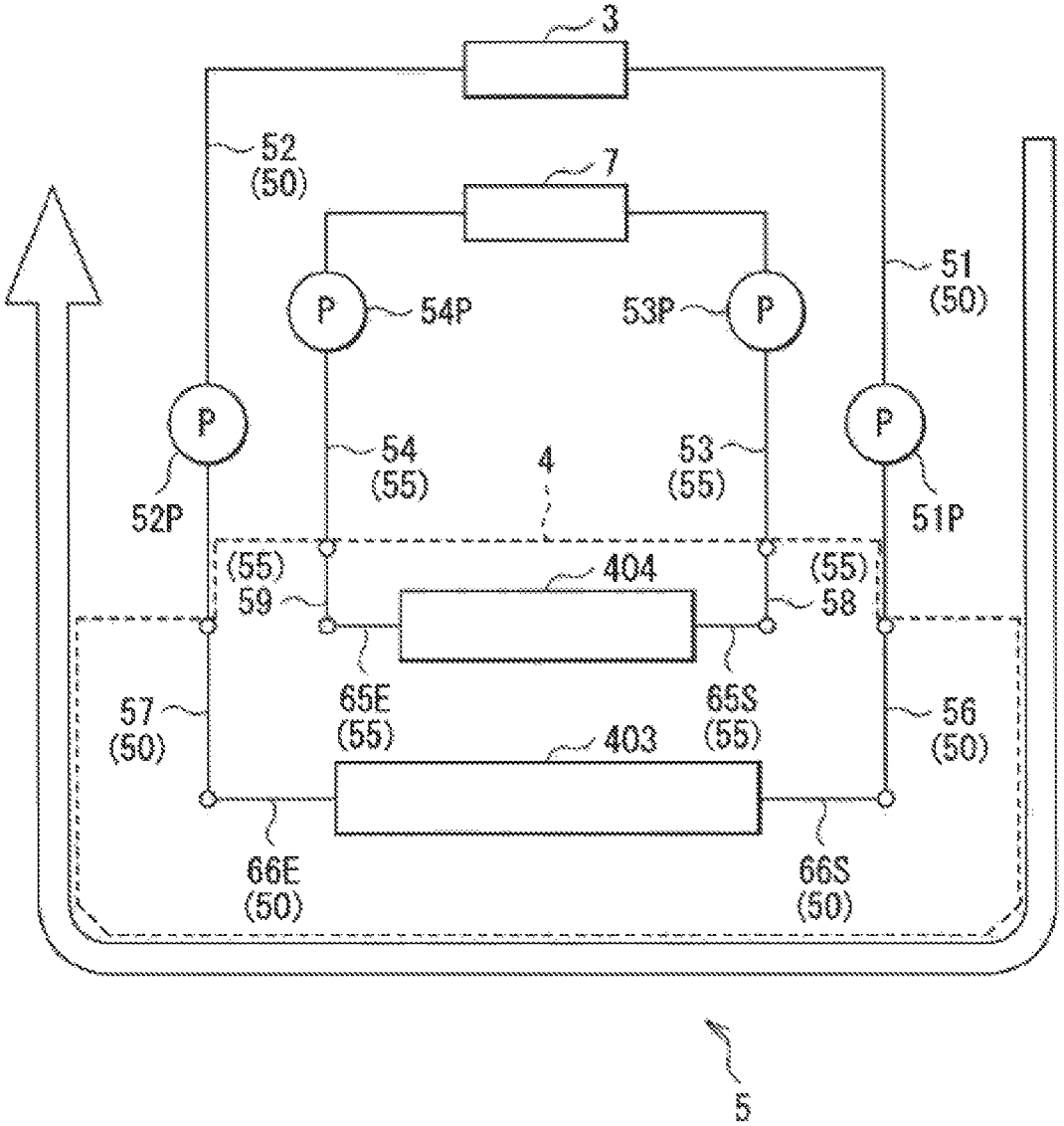
FIG. 2B is a schematic diagram showing a schematic configuration example of a circulation mechanism in a second mode of the jet recording device shown in FIG. 1.

FIG. 2A and FIG. 2B are each a schematic diagram showing a schematic configuration example in the circulation mechanism 5. In particular, FIG. 2A shows the schematic configuration example corresponding to a first mode described later, and FIG. 2B shows the schematic configuration example corresponding to a second mode described later. The circulation mechanism 5 has the ink circulation channels 50 each configured including an ink supply tube 51, an ink discharge tube 52, an ink inflow tube 56, ink relay pipes 66S, 66E and an ink outflow tube 57, and the refrigerant circulation channel 55 configured including a refrigerant supply tube 53, a refrigerant discharge tube 54, refrigerant inflow tubes 58, refrigerant relay pipes 65S, 65E and refrigerant outflow tubes 59. It should be noted that the ink inflow tube 56, the ink relay pipes 66S, 66E and the ink outflow tube 57 as some of the constituents of the ink circulation channel 50 are all also constituents of the inkjet head 4. Further, the refrigerant inflow tube 58, the refrigerant relay pipes 65S, 65E and the refrigerant outflow tube 59 as some of the constituents of the refrigerant circulation channel 55 are all also the constituents of the inkjet head 4. In the circulation mechanism 5, it is arranged that the ink and the refrigerant respectively flow through the ink circulation channel 50 and the refrigerant circulation channel 55 along the arrow direction in the drawing. The constituents (the ink supply tube 51, the ink discharge tube 52, the ink inflow tube 56, the ink relay pipes 66S, 66E and the ink outflow tube 57) constituting the ink circulation channel 50 are formed of a material having corrosion resistance to the ink flowing inside the constituents. Similarly, the constituents (the refrigerant supply tube 53, the refrigerant discharge tube 54, the refrigerant inflow tube 58, the refrigerant relay pipes 65S, 65E and the refrigerant outflow tube 59) constituting the refrigerant circulation channel 55 are formed of a material having corrosion resistance to the refrigerant flowing inside the constituents.

In each of the ink circulation channels 50, the ink supply tube 51 and the ink discharge tube 52 are disposed so as to connect the ink tank 3 and the head chip 403 to each other. It should be noted that the ink inflow tube 56 and the ink relay pipe 66S for connecting the ink supply tube 51 and the head chip 403 to each other are disposed between the ink supply tube 51 and the head chip 403, and the ink relay pipe 66E and the ink outflow tube 57 for connecting the head chip 403 and the ink discharge tube 52 to each other are disposed between the head chip 403 and the ink discharge tube 52. On the other hand, in the refrigerant circulation channel 55, the refrigerant supply tube 53 and the refrigerant discharge tube 54 are disposed so as to connect the refrigerant tank 7 and the cooling sections 404 to each other. It should be noted that the refrigerant inflow tube 58 and the refrigerant relay pipe 65S for connecting the refrigerant supply tube 53 and the cooling section 404 to each other are disposed between the refrigerant supply tube 53 and the cooling section 404, and the refrigerant relay pipe 65E and the refrigerant outflow tube 59 for connecting the cooling section 404 and the refrigerant discharge tube 54 to each other are disposed between the cooling section 404 and the refrigerant discharge tube 54. It should be noted that the refrigerant tank 7 can be installed inside or outside the printer 1. Further, it is preferable for the refrigerant discharge tube 54 to be arranged to pass through a heat exchanger for cooling the refrigerant flowing inside the heat exchanger.

The circulation mechanism 5 is further provided with a pressure pump 51P provided to the ink supply tube 51, a suction pump 52P provided to the ink discharge tube 52, a pressure pump 53P provided to the refrigerant supply tube 53, and a suction pump 54P provided to the refrigerant discharge tube 54. The ink supply tubes 51, the ink discharge tubes 52, the refrigerant supply tube 53 and the refrigerant discharge tube 54 are each formed of, for example, a flexible hose having flexibility to the extent of being capable of following the motion of the scanning mechanism 6 for supporting the inkjet heads 4.

Further, in the circulation mechanism 5, it is arranged that either one of the connection between the refrigerant inflow tube 58 and the refrigerant supply tube 53 and the connection between the refrigerant relay pipe 65S and the ink inflow tube 56 can selectively be achieved. Similarly, it is arranged that either one of the connection between the refrigerant outflow tube 59 and the refrigerant discharge tube 54 and the connection between the refrigerant relay pipe 65E and the ink outflow tube 57 can selectively be achieved.

It should be noted that the ink inflow tube 56, the ink outflow tube 57, the refrigerant inflow tube 58 and the refrigerant outflow tube 59 are specific examples corresponding respectively to a "liquid inflow tube," a "liquid outflow tube," a "refrigerant inflow tube," and a "refrigerant outflow tube" of the present disclosure.

[Detailed Configuration of Inkjet Heads 4]

Figure 3A:
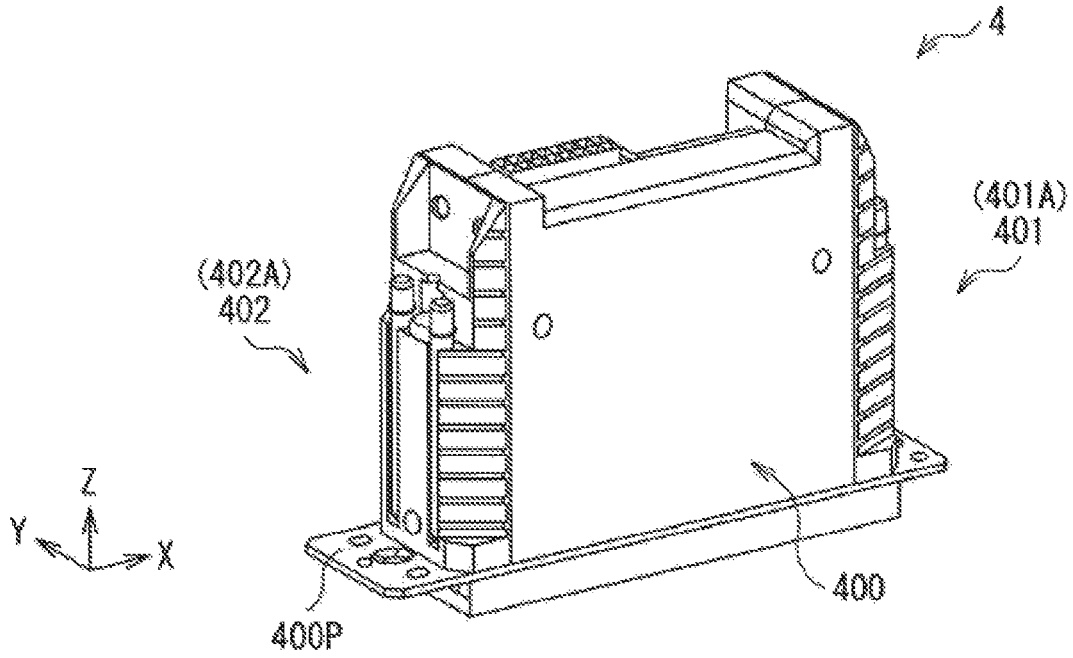
FIG. 3A is a perspective view showing an appearance of a liquid jet head shown in FIG. 1.
Figure 3B:
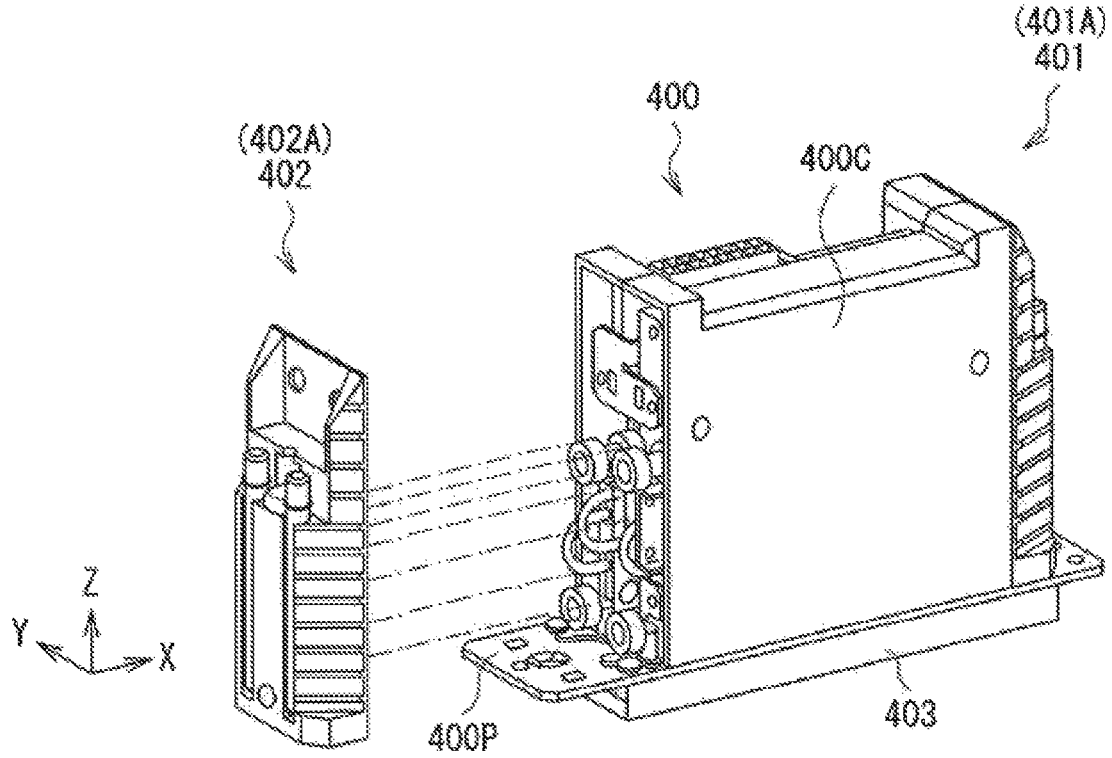
FIG. 3B is a perspective view showing a part of an internal structure of the liquid jet head shown in FIG. 1.

Then, the detailed configuration example of the head chip 4 will be described with reference to FIG. 3 through FIG. 14 in addition to FIG. 1 and FIG. 2. FIG. 3A is a perspective view showing an overall configuration example of the inkjet head 4. FIG. 3B is a perspective view showing a part of an internal structure of the inkjet head 4.

As shown in FIG. 3A and FIG. 3B, the inkjet head 4 has a main body part 400, a cover unit 401 and a cover unit 402. The cover unit 401 and the cover unit 402 are each configured so as to detachably be attached to the main body part 400. It should be noted that as the cover unit 401, it is possible to select either one of a cover unit 401A corresponding to a specific example of a "first inflow side cover member" of the present disclosure and a cover unit 401B corresponding to a specific example of a "second inflow side cover member" of the present disclosure. On the other hand, as the cover unit 402, it is possible to select either one of a cover unit 402A corresponding to a specific example of a "first outflow side cover member" of the present disclosure and a cover unit 402B corresponding to a specific example of a "second outflow side cover member" of the present disclosure. Although there is illustrated the case in which the cover unit 401A and the cover unit 402A are selected in FIG. 3A and FIG. 3B, the inkjet head 4 of the present disclosure is arranged so that it is possible to select the cover unit 401B and the cover unit 402B to be attached to the main body part 400. It should be noted that the details of the cover unit 401 and the cover unit 402 will be described later.

The main body part 400 has a base plate 400P to be attached to the pedestal 62*a* of the carriage 62, and a head chip 403 disposed on the side opposed to the recording paper P viewed from the base plate 400P. The base plate 400P is a plate-like member having the Y-axis direction as the longitudinal direction and the X-axis direction as the shortside direction, and extending along the X-Y plane. The head chip 403 includes the ink circulation channel 50 through which the ink as the liquid passes, and for jetting the ink from the plurality of nozzles H1, H2. In the present specification, the head chip 403 is disposed on the lower side in the vertical direction of the base plate 400P. Further, a part of the main body part 400 located on the opposite side to the head chip 403 viewed from the base plate 400P is covered with a cover member 400C.

Figure 4A:
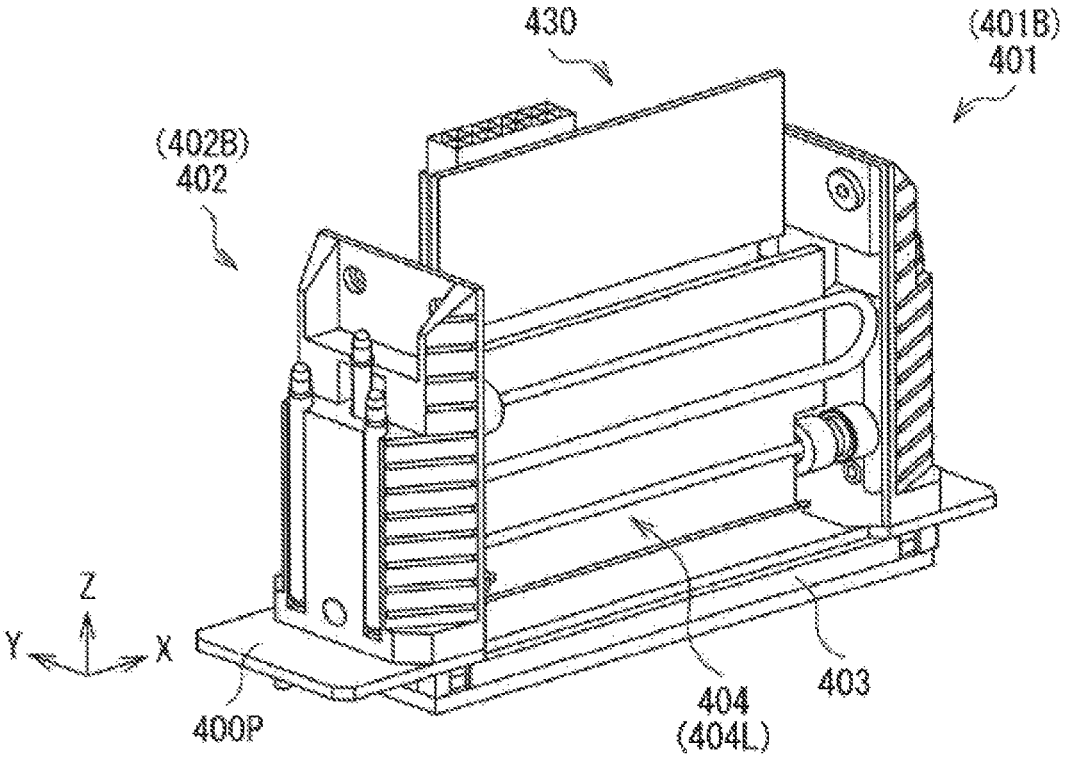
FIG. 4A is an exploded perspective view showing the internal structure of the liquid jet head shown in FIG. 1.
Figure 4B:
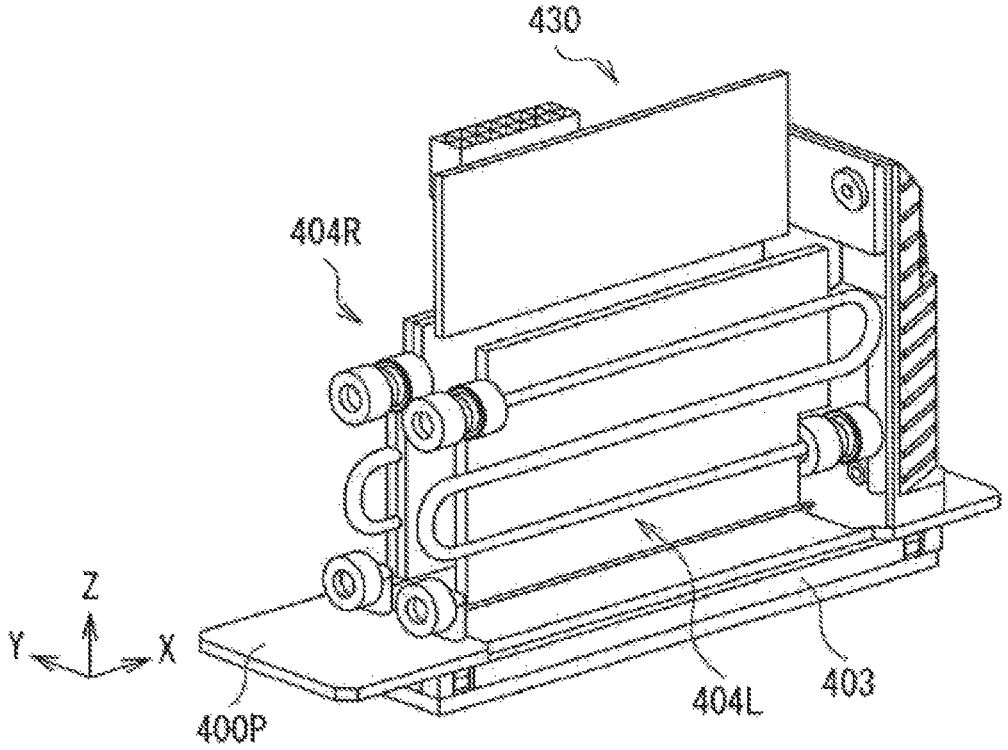
FIG. 4B is another exploded perspective view showing the internal structure of the liquid jet head shown in FIG. 1.

FIG. 4A is a perspective view showing an internal structure of the inkjet head 4 in a state in which the cover member 400C is removed. FIG. 4B is a perspective view showing the internal structure of the inkjet head 4 in a state in which the cover unit 402 is further removed in the state shown in FIG. 4A. It should be noted that in FIG. 4A and FIG. 4B, there is illustrated the state in which the cover unit 401B and the cover unit 402B are selected to be attached to the main body part 400.

As shown in FIG. 4A and FIG. 4B, the main body part 400 further includes a control circuit 430 and the cooling section 404 disposed on the opposite side (i.e., upper side in the vertical direction) to the head chip 403 viewed from the base plate 400P. The cooling section 404 is constituted by two cooling sections 404L, 404R adjacent to each other in, for example, the Y-axis direction. The control circuit 430 includes the driver IC and so on, and is provided to a plate-like member extending along the X-Z plane perpendicular to, for example, the base plate 400P. The driver IC is for controlling, for example, an operation of the head chip 403 and an operation of the circulation mechanism 5.

Figure 5A:
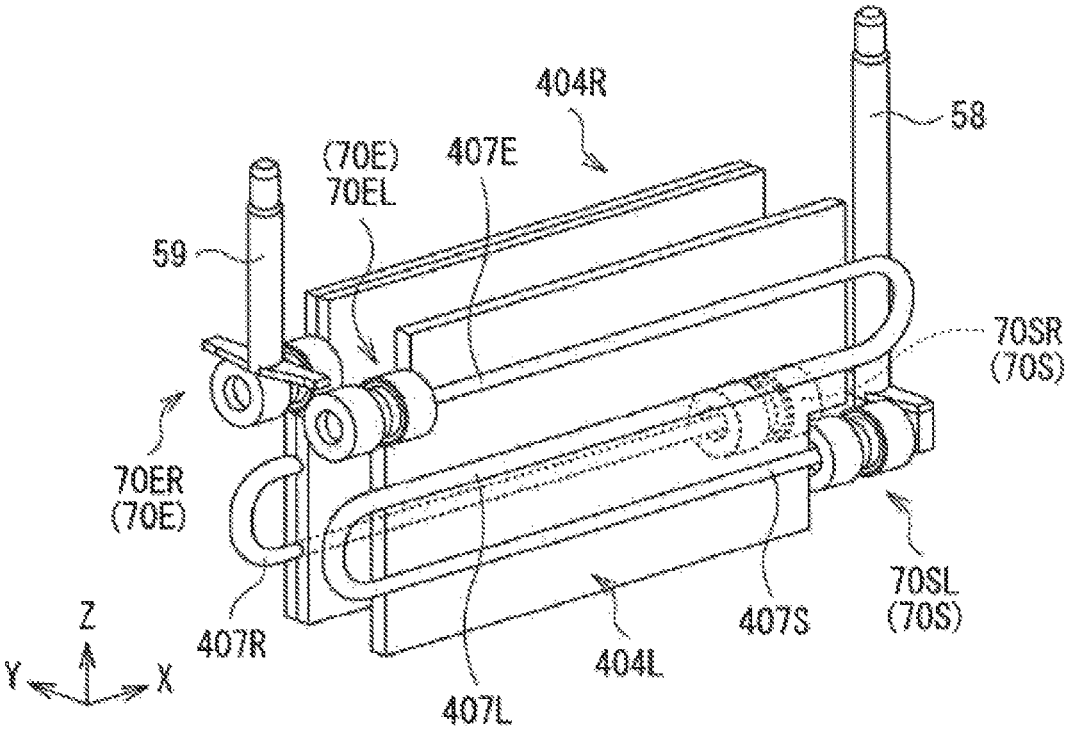
FIG. 5A is an exploded perspective view showing a cooling section disposed inside the liquid jet head shown in FIG. 1.
Figure 5B:
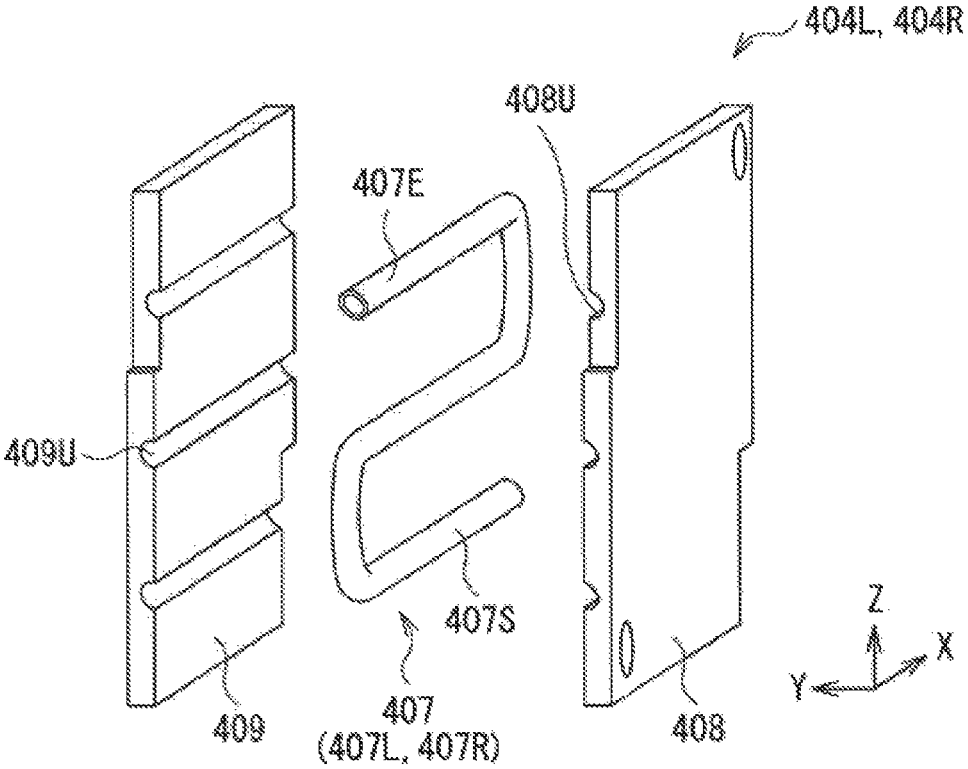
FIG. 5B is an enlarged exploded perspective view showing a substantial part of the cooling section shown in FIG. 5A.

FIG. 5A is a perspective view showing the cooling sections 404L, 404R and the constituents around the cooling sections 404L, 404R, and FIG. 5B is an exploded perspective view of the cooling sections 404L, 404R. As shown in FIG. 5B, the cooling sections 404L, 404R each have a cooling pipe 407 (407L, 407R) which meanders so as to form, for example, an S shape, and through which the refrigerant passes, a pair of cooling plates 408, 409 opposed to each other across the cooling pipe 407 in the X-axis direction so as to have contact with an outer surface of the cooling pipe 407, and joints 70 (70S, 70E) respectively connected to the both ends of the cooling pipe 407. The cooling pipe 407 is preferably formed of a corrosion-resistant material having corrosion resistance to the ink such as stainless steel.

The pair of cooling plates 408, 409 are provided with grooves 408U, 409U each having a semicircular cross-sectional shape corresponding to the outside diameter of the cooling pipe 407 formed on the respective surfaces opposed to each other so that the inner surfaces of the grooves 408U, 409U have contact with the outer surface of the cooling pipe 407. It should be noted that the pair of cooling plates 408, 409 are arranged to clamp only straight parts as parts of the cooling pipe 407 in the present embodiment, but can also be arranged to also clamp curved parts of the cooling pipe 407. It is preferable for the pair of cooling plates 408, 409 to be formed of a highly heat-conductive material having a higher thermal conductivity than the thermal conductivity of the corrosion-resistant material constituting the cooling pipe 407. Specifically, it is preferable for the pair of cooling plates 408, 409 to be formed of, for example, a simple body of aluminum or an aluminum alloy.

The cooling pipe 407 has a refrigerant inflow port 407S in which the refrigerant inflows, and a refrigerant outflow port 407E from which the refrigerant outflows. Here, it is preferable for the cooling pipe 407 to be installed so that the height position of the refrigerant inflow port 407S is lower than the height position of the refrigerant outflow port 407E. As shown in FIG. 5A, the refrigerant inflow ports 407S are connected to the refrigerant inflow tube 58 via the joints 70S (70SL, 70SR) and the refrigerant relay pipes 65SL, 65SR (see FIG. 7 or FIGS. 10A through 11B described later), respectively, and the refrigerant outflow ports 407E are connected to the refrigerant outflow tube 59 via the joints 70E (70EL, 70ER), the refrigerant relay pipes 65EL, 65ER (see FIG. 7 or FIGS. 10A through 11B described later), and so on, respectively. It should be noted that FIG. 5A corresponds to the state in which the cover units 401B, 402B are mounted. The detailed structure of the refrigerant inflow tube 58 and the refrigerant outflow tube 59 will be described later. As shown in FIG. 5A, the joint 70SL is connected to the refrigerant inflow port 407S of the cooling pipe 407L in the cooling section 404L, and the joint 70SR is connected to the refrigerant inflow port 407S of the cooling pipe 407R in the cooling section 404R. Further, the joint 70EL is connected to the refrigerant outflow port 407E of the cooling pipe 407L in the cooling section 404L, and the joint 70ER is connected to the refrigerant outflow port 407E of the cooling pipe 407R in the cooling section 404R. In the present specification, those joints 70S (70SL, 70SR) and the joints 70E (70EL, 70ER) are collectively described as joints 70.

(Joints 70)

Figure 6A:
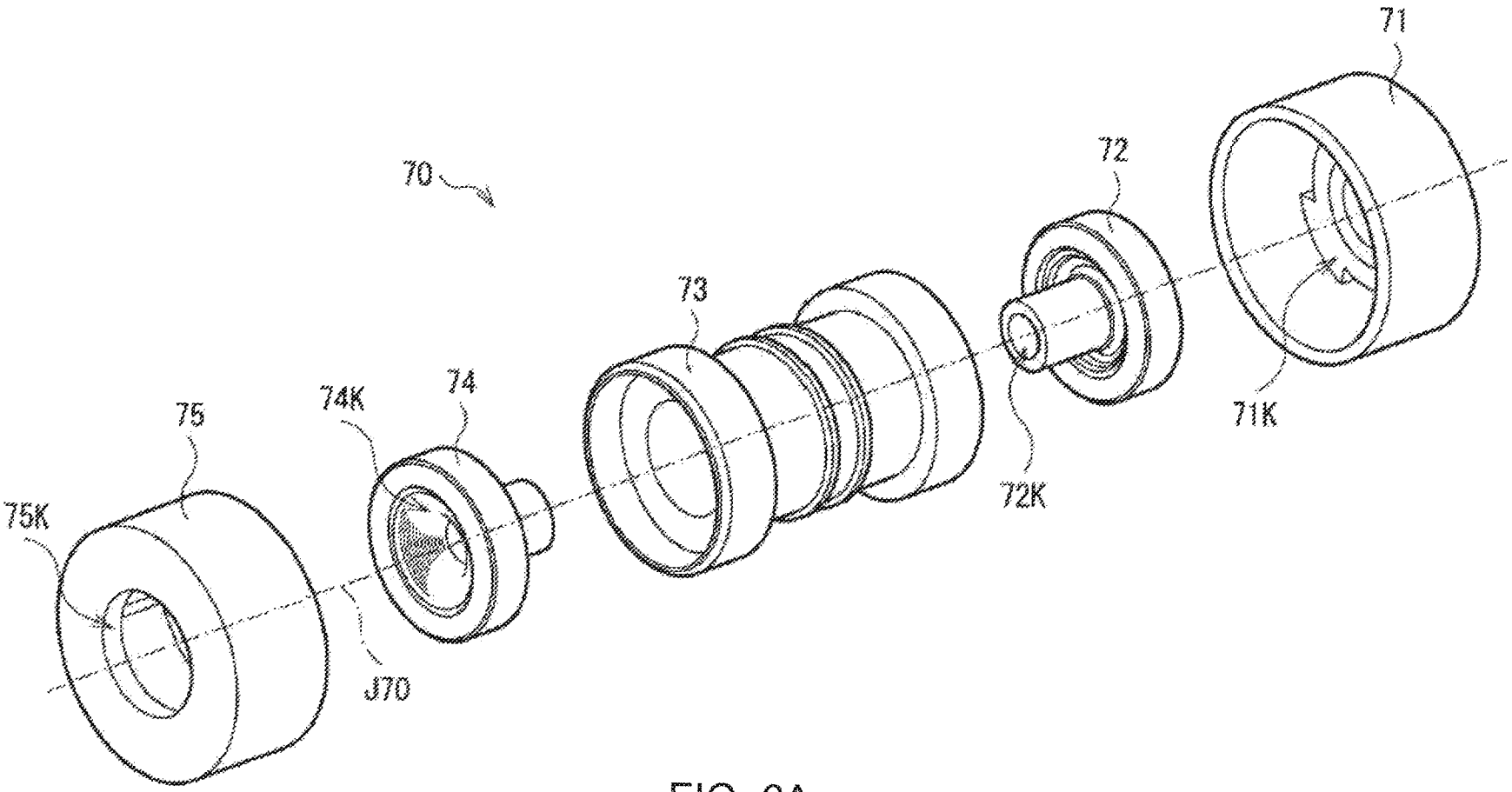
FIG. 6A is an exploded perspective view showing a connection section provided to a refrigerant flow channel included in the liquid jet head shown in FIG. 1.
Figure 6B:
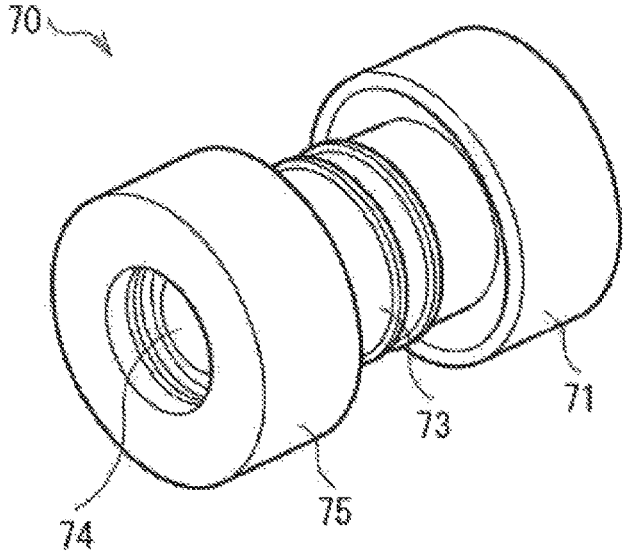
FIG. 6B is a perspective view showing an appearance of the connection section shown in FIG. 6A.
Figure 6C:
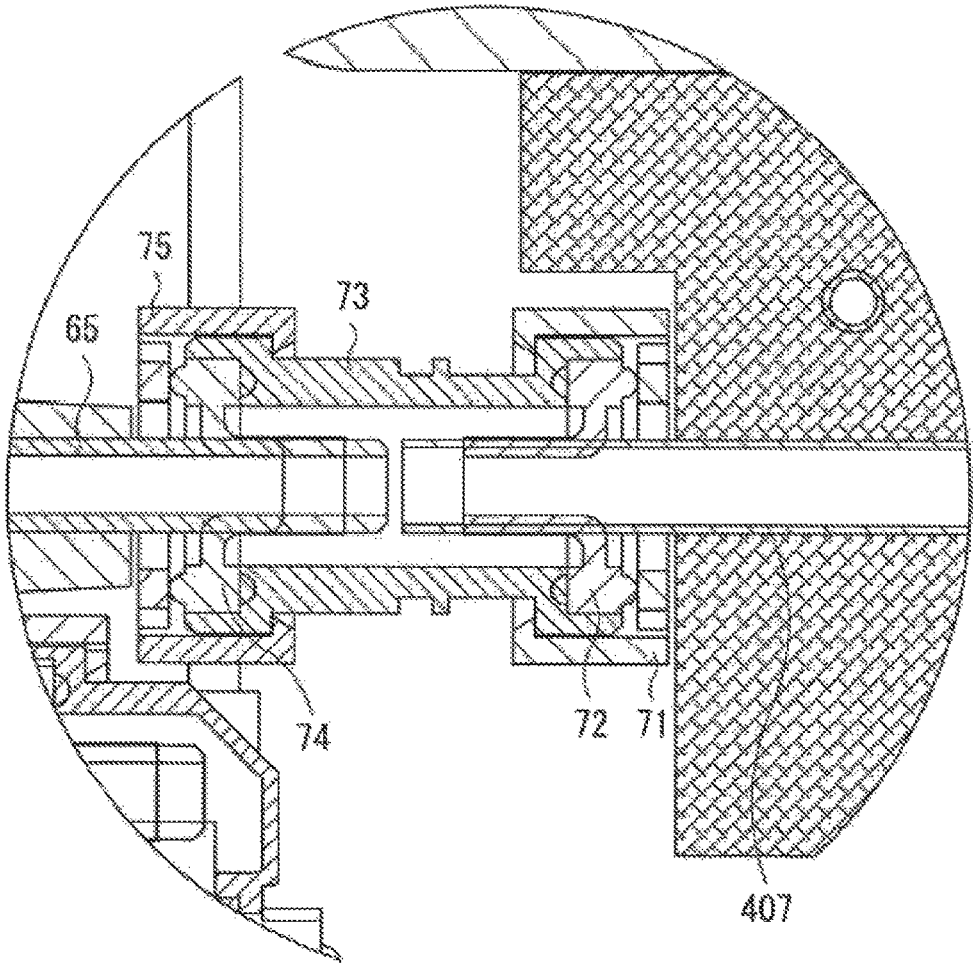
FIG. 6C is a cross-sectional view of the connection section shown in FIG. 6A.

FIG. 6A is an exploded perspective view showing the joint 70. FIG. 6B is a perspective view showing an appearance of the joint 70 in the assembled state. Further, FIG. 6C is a cross-sectional view of the joint 70 and the vicinity of the joint 70.

As shown in FIG. 6A, in the joint 70, an inside cap 71, an inside sleeve 72, a relay 73, an outside sleeve 74, and an outside cap 75 are arranged along an axis J70 in this order from, for example, a position (the side to be connected to the refrigerant inflow port 407S or the refrigerant outflow port 407E) close to the central position of the main body part 400. The refrigerant is arranged to flow inside the joint 70 along the axis J70. The inside sleeve 72 and the outside sleeve 74 are made of an elastic material. It should be noted that the outside sleeve 74 is a specific example corresponding to an "elastic connection member" in the present disclosure. Further, the inside sleeve 72 is not required to be provided with the same structure as the outside sleeve 74 providing the inside sleeve 72 is for ensuring the flow channel of the ink or the like flowing inside so as not to be leaked.

On the axis J70, the inside cap 71 has an opening 71K, and the inside sleeve 72 has an opening 72K. As shown in FIG. 6C, it is arranged that an end part (i.e., the refrigerant inflow port 407S or the refrigerant outflow port 407E) of the cooling pipe 407 is inserted into the opening 72K of the inside sleeve 72 through the opening 71K of the inside cap 71, and thus, the cooling pipe 407 is held by the inside sleeve 72 in the state in which the inner surface of the inside sleeve 72 and the outer surface of the cooling pipe 407 have close contact with each other. In contrast, the outside cap 75 and the outside sleeve 74 respectively have an opening 75K and an opening 74K on the axis J70. As shown in FIG. 6C, it is arranged that the refrigerant relay pipe 65S, 65E is inserted into the opening 74K of the outside sleeve 74 through the opening 75K of the outside cap 75, and thus, the refrigerant relay pipe 65S, 65E is held by the outside sleeve 74 in the state in which the inner surface of the outside sleeve 74 and the outer surface of the refrigerant relay pipe 65S, 65E have close contact with each other. It should be noted that here, the refrigerant relay pipes 65SL, 65SR are collectively referred to and described as the refrigerant relay pipes 65S, and the refrigerant relay pipes 65EL, 65ER are collectively referred to and described as the refrigerant relay pipes 65E.

Figure 6D:
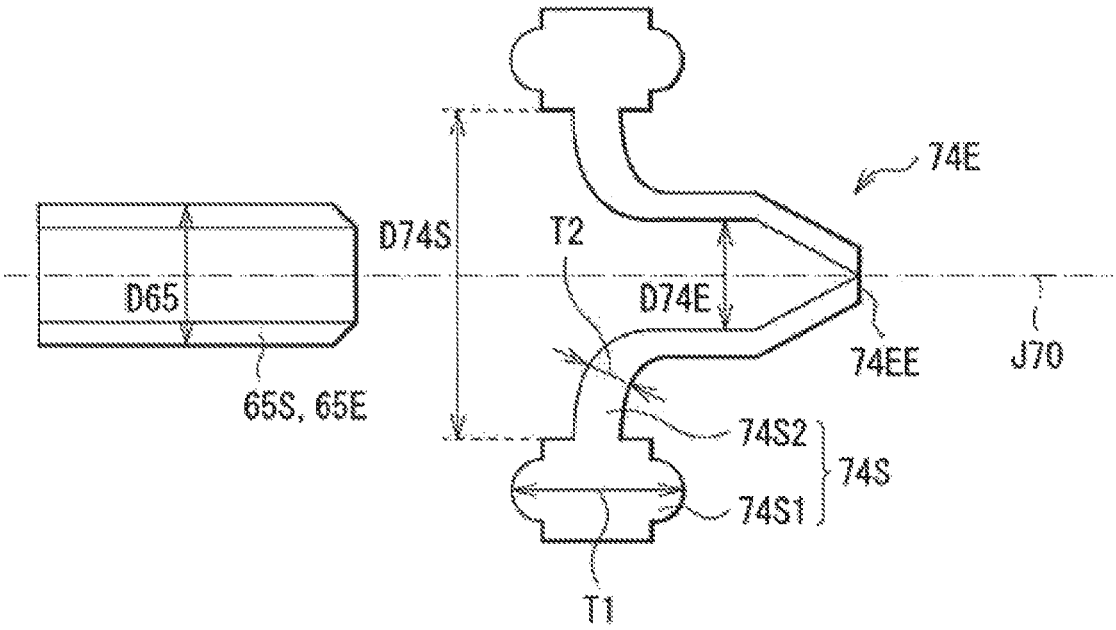
FIG. 6D is a cross-sectional view showing a constituent of the connection section shown in FIG. 6A.
Figure 6E:
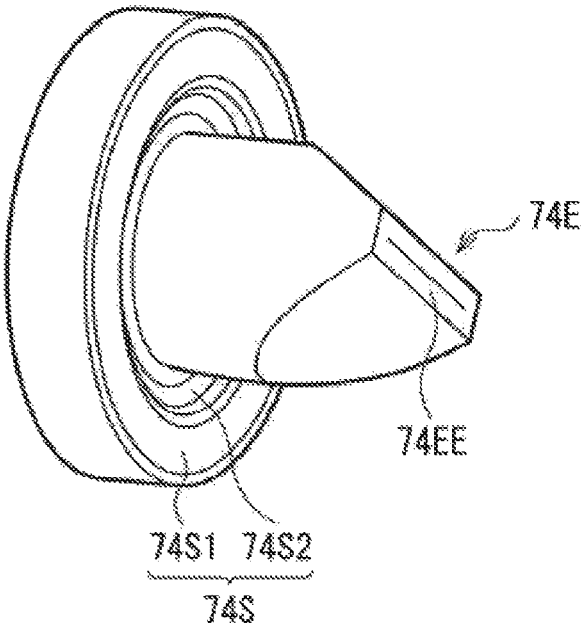
FIG. 6E is a perspective view showing a constituent of the connection section shown in FIG. 6A.

FIG. 6D is a cross-sectional view showing a cross-section of the outside sleeve 74 constituting the joint 70, and FIG. 6E is a perspective view showing an appearance of the outside sleeve 74. It should be noted that FIG. 6D and FIG. 6E both show the detached state in which the refrigerant relay pipe 65S, 65E is not inserted. The outside sleeve 74 has an inside end part 74E located on the main body part 400 side, and an outside end part 74S located on the opposite side to the main body part 400. In the detached state in which the refrigerant relay pipe 65S, 65E is not inserted into the opening 74K of the outside sleeve 74, the outside diameter D65 of the refrigerant relay pipe 65S, 65E is larger than the inside diameter D74E of the inside end part 74E of the outside sleeve 74, and is smaller than the inside diameter D74S of the outside end part 74S of the outside sleeve 74. Further, the opening 74K in the outside end part 74S of the outside sleeve 74 is formed so that the inside diameter D74S of the opening 74K gradually decreases as the distance from the refrigerant relay pipe 65S, 65E increases. The inside end part 74E of the outside sleeve 74 is, for example, a duckbill valve, and is set to the state in which an end edge 74EE is closed in the detached state in which the refrigerant relay pipe 65S, 65E is not inserted. Further, the outside end part 74S of the outside sleeve 74 has a thick wall part 74S1 and a thin wall part 74S2 located on an inner side (a position close to the inside end part 74E) of the thick wall part 74S1. The thickness T1 of the thick wall part 74S1 is thicker than the thickness T2 of the thin wall part 74S2 (T1>T2). It should be noted that the opening 74K of the outside sleeve 74 is a specific example of an "insertion port" in the present disclosure.

Figure 7:
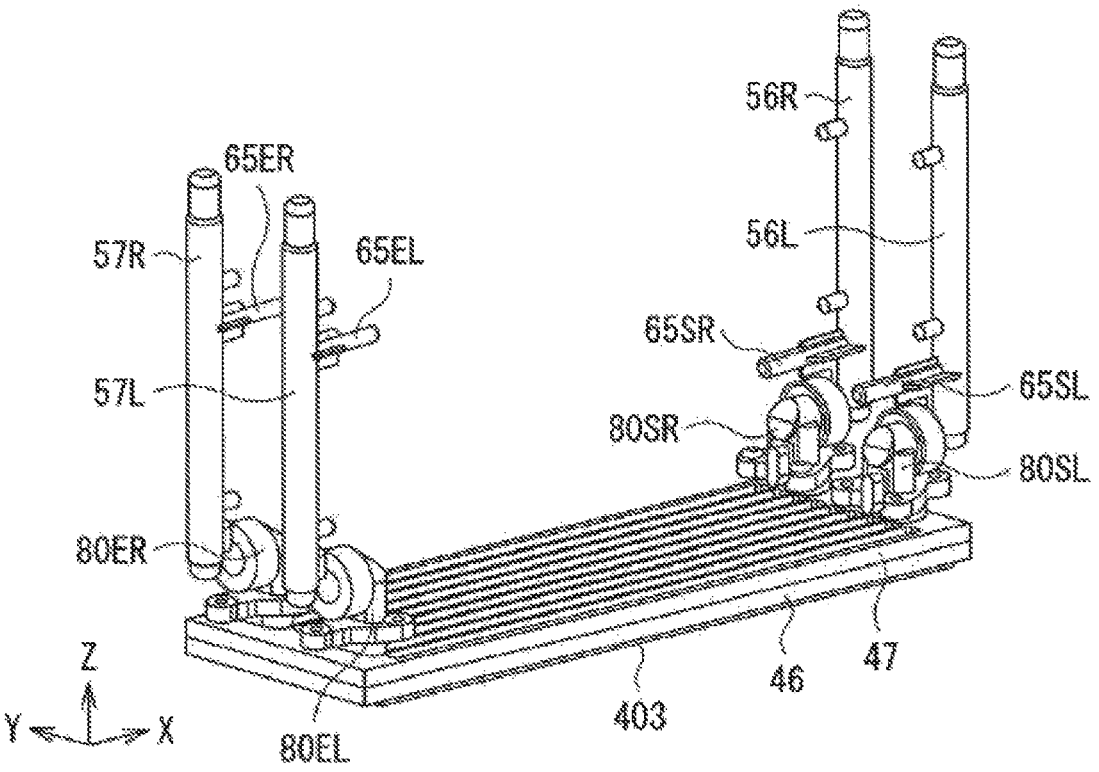
FIG. 7 is a perspective view showing a liquid flow channel included in the liquid jet head shown in FIG. 1.

FIG. 7 is a perspective view showing base joints 80, an inside flow channel plate 47, an outside flow channel plate 46 and the head chip 403, and the ink inflow tubes 56 (56L, 56R) and the ink outflow tubes 57 (57L, 57R) in the main body part 400. The base joints 80, the inside flow channel plate 47, the outside flow channel plate 46 and the head chip 403 shown in FIG. 7 include the liquid flow channel through which the ink flows in the inkjet head 4. The outside flow channel plate 46 and the inside flow channel plate 47 are stacked in sequence on the head chip 403, and further, the two base joints 80 (80S, 80E) are disposed adjacent to each of the both ends in the longitudinal direction (the X-axis direction) of the inside flow channel plate 47. It should be noted that a flexible film not shown is inserted between the inside flow channel plate 47 and the outside flow channel plate 46. To the two base joints 80S (80SL, 80SR) disposed in the vicinity of one end (an end part on the ink inflow side) in the X-axis direction of the inside flow channel plate 47, there are respectively connected the ink inflow tubes 56, and to the tow base joints 80E (80EL, 80ER) disposed in the vicinity of the other end (an end part on the ink outflow side) in the X-axis direction of the inside flow channel plate 47, there are respectively connected the ink outflow tubes 57. It should be noted that in FIG. 7, there is illustrated the state in which the cover unit 401A and the cover unit 402A are selected to be attached to the main body part 400. In other words, it is arranged that in the case in which the cover unit 401A and the cover unit 402A are selected, the refrigerant relay pipes 65S are connected to the ink inflow tubes 56, and at the same time, the refrigerant relay pipes 65E are connected to the ink outflow tubes 57.

Figure 8A:
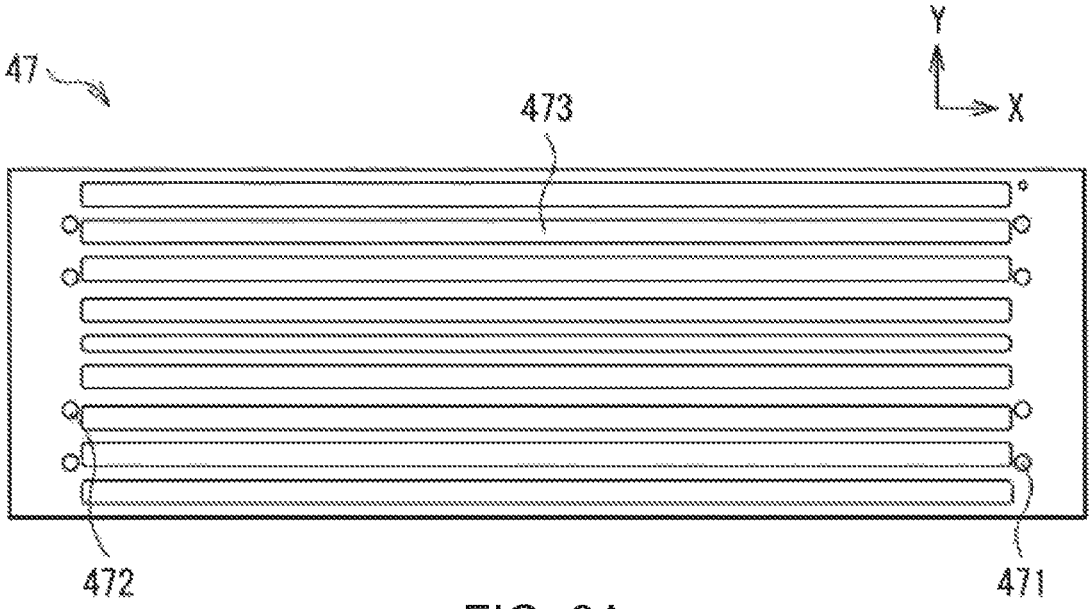
FIG. 8A is a plan view showing an inside flow channel plate included in the liquid jet head shown in FIG. 1.
Figure 8B:
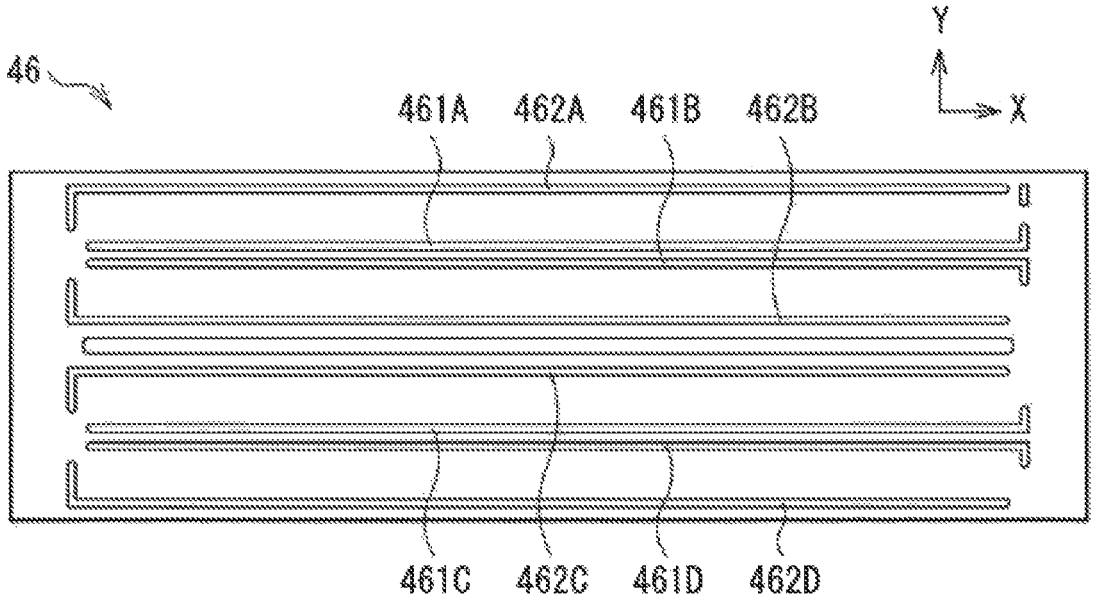
FIG. 8B is a plan view showing an outside flow channel plate included in the liquid jet head shown in FIG. 1.
Figure 8C:
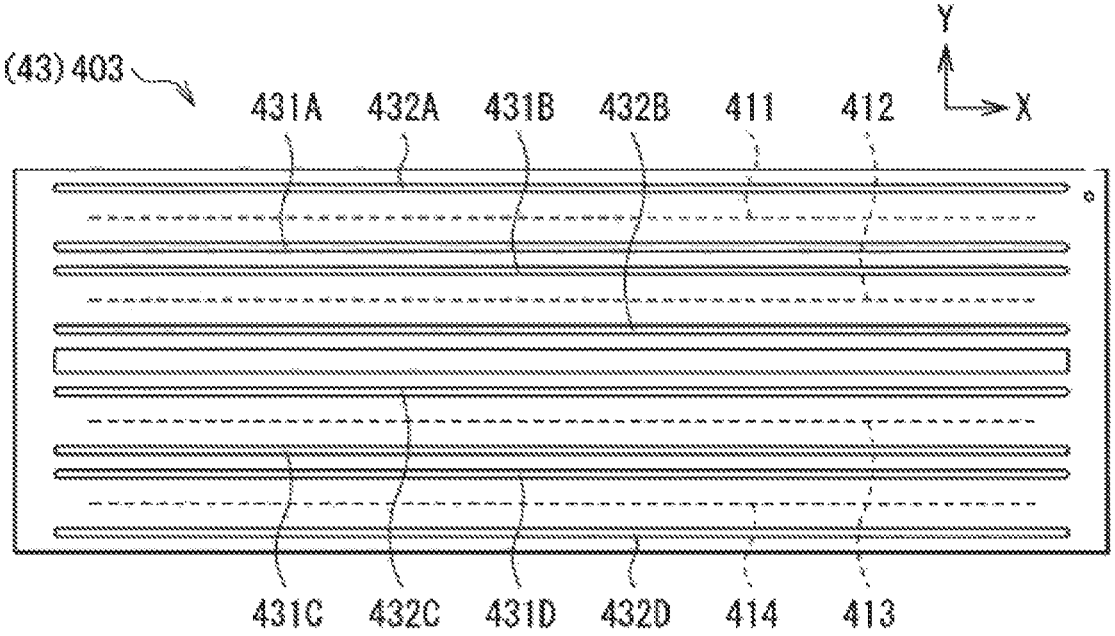
FIG. 8C is a plan view showing a head chip included in the liquid jet head shown in FIG. 1.

FIG. 8A through FIG. 8C are plan views respectively showing the state in which the inside flow channel plate 47 is viewed from the −Z direction, the state in which the outside flow channel plate 46 is viewed from the −Z direction, and the state in which the cover plate 43 is viewed from the −Z direction. As shown in FIG. 8A, the inside flow channel plate 47 has four inflow holes 471 disposed at positions corresponding respectively to the base joints 80SL, 80SR, four outflow holes 472 disposed at positions corresponding respectively to the base joints 80EL, 80ER, and a plurality of slits 473 each extending in the X-axis direction and arranged in the Y-axis direction. It should be noted that the slits 473 of the inside flow channel plate 47 are all sealed by the flexible film inserted between the inside flow channel plate 47 and the outside flow channel plate 46. As shown in FIG. 8B, the outside flow channel plate 46 has slits 461A through 461D and slits 462A through 462D each extending in the X-axis direction. It should be noted that one ends of the slits 461A through 461D are each disposed at a position corresponding to either one of the two inflow holes 471 in the Z-axis direction, and one ends of the slits 462A through 462D are each disposed at a position corresponding to either one of the two outflow holes 472 in the Z-axis direction. As shown in FIG. 8C, the cover plate 43 has ink chambers 431A through 431D and ink chambers 432A through 432D each extending in the X-axis direction. It should be noted that the ink chambers 431A through 431D are disposed at positions corresponding respectively to the slits 461A through 461D in the Z-axis direction, and the ink chambers 432A through 432D are disposed at positions corresponding respectively to the slits 462A through 462D in the Z-axis direction. It should be noted that the inflow holes 471 and the outflow holes 472 of the inside flow channel plate 47, the slits 461A through 461D, 462A through 462D of the outside flow channel plate 46, and the ink chambers 431A through 431D, 432A through 432D of the cover plate 43 constitute a liquid flow channel through which the ink flows in the inkjet head 4.

(Base Joints 80)

Figure 9:
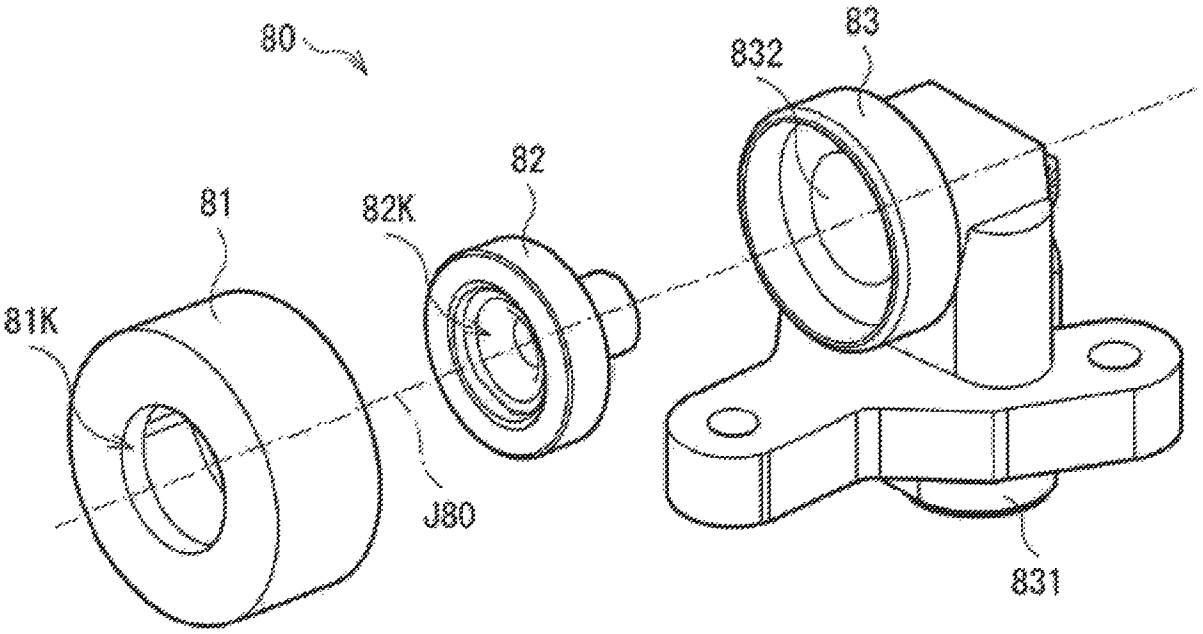
FIG. 9 is an exploded perspective view showing a connection section provided to the liquid flow channel shown in FIG. 7.

FIG. 9 is an exploded perspective view showing the base joint 80. As shown in FIG. 9, in the base joint 80, a cap 81, a sleeve 82 and a base 83 are disposed along an axis J80 in sequence from, for example, the outer side (a side to be connected to the ink relay pipe 66E of the ink inflow tube 56 or the ink outflow tube 57) of the main body part 400. The ink is arranged to flow inside the base joint 80. Specifically, the ink from the ink inflow tube 56 inflows into the base 83 from an end part 832 through an opening 81K of the cap 81 and an opening 82K of the sleeve 82, and then outflows from an end part 831 toward the inflow hole 471 of the inside flow channel plate 47. Alternatively, it is arranged that the ink having flowed out from the outflow hole 472 of the inside flow channel plate 47 inflows from the end part 831 into the base 83, and then passes through the opening 82K of the sleeve 82 provided to the end part 832 and the opening 81K of the cap 81 in sequence to reach the ink outflow tube 57. The sleeve 82 is made of an elastic material, and has substantially the same structure as that of the outside sleeve 74 in the joint 70. In other words, for example, the inside end part of the sleeve 82 is also a duckbill valve. It should be noted that the sleeve 82 is a specific example corresponding to an "elastic connection member" in the present disclosure.

The cap 81 has the opening 81K, and the sleeve 82 has the opening 82K. It is arranged that the end part of the ink relay pipe 66S, 66E is inserted into the opening 82K of the sleeve 82 through the opening 81K of the cap 81, and the ink relay pipe 66S, 66E is held by the sleeve 82 in the state in which the inside surface of the sleeve 82 and the outside surface of the ink relay pipe 66S, 66E have close contact with each other.

(Cover Units 401A, 402A)

Figure 10A:
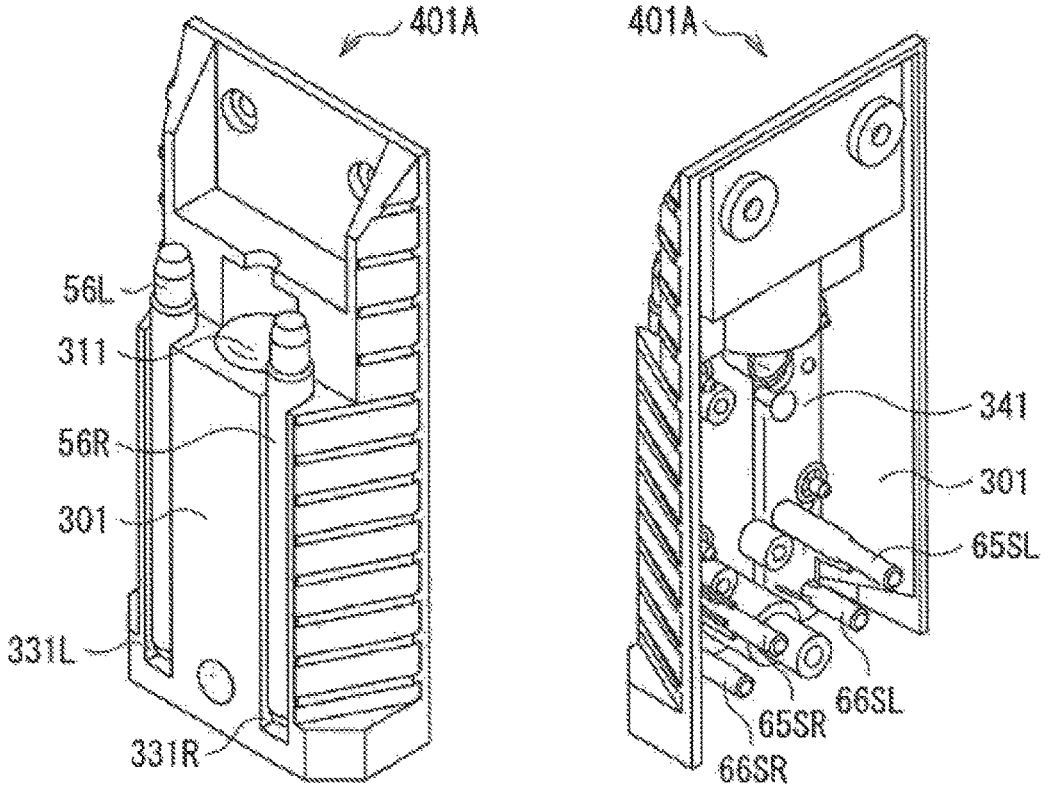
FIG. 10A is a perspective view showing a first inflow side cover unit included in the liquid jet head shown in FIG. 1.
Figure 10B:
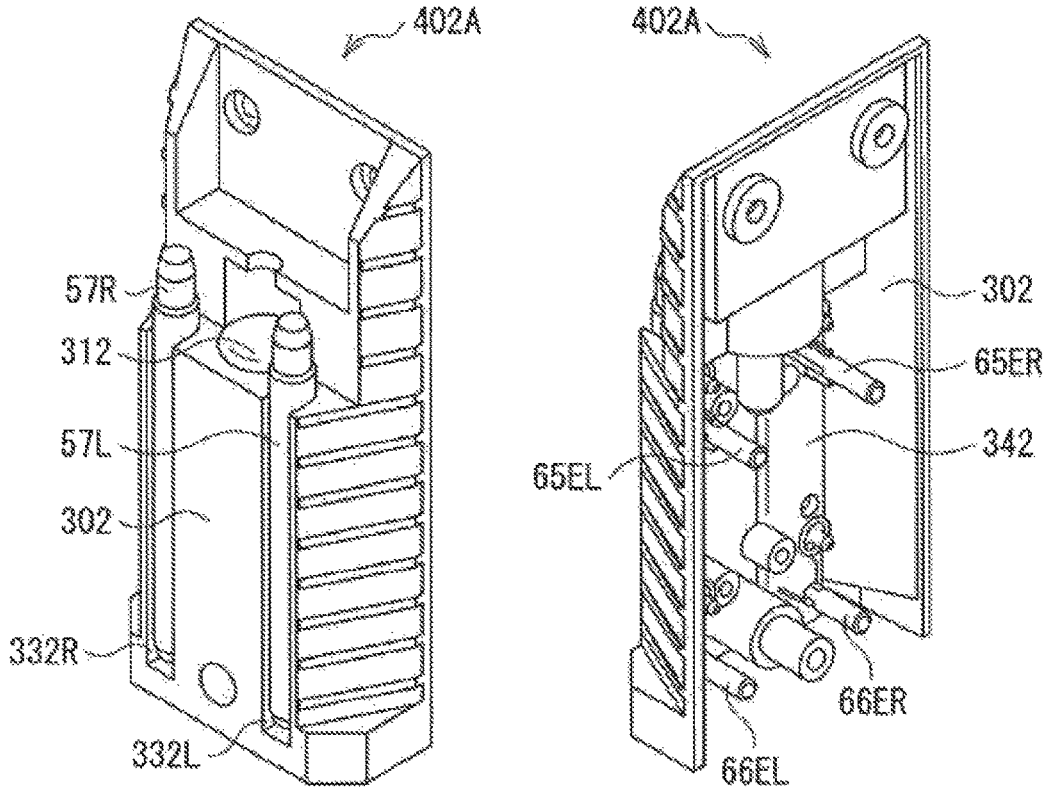
FIG. 10B is a perspective view showing a first outflow side cover unit included in the liquid jet head shown in FIG. 1.

FIG. 10A is a perspective view showing a configuration of the cover unit 401A. The diagram on the left side of FIG. 10A shows the state of the cover unit 401A viewed from the outside (an opposite side to the side to be mounted on the main body part 400), and the diagram on the right side of FIG. 10A is a perspective view showing the state of the cover unit 401A viewed from the inside (the side to be mounted on the main body part 400). Further, FIG. 10B is a perspective view showing a configuration of the cover unit 402A. The diagram on the left side of FIG. 10B shows the state of the cover unit 402A viewed from the outside, and the diagram on the right side of FIG. 10B is a perspective view showing the state of the cover unit 402A viewed from the inside.

As shown in FIG. 10A, the cover unit 401A has a cover main body 301, the ink inflow tubes 56L, 56R, the refrigerant relay pipes 65SL, 65SR, and the ink relay pipes 66SL, 66SR. The cover main body 301 includes a plug 311 for blocking an opening 321 (see FIG. 11A described later), and grooves 331L, 331R each extending in the Z-axis direction and arranged in the Y-axis direction. The ink inflow tubes 56L, 56R are respectively housed in the grooves 331L, 331R of the cover main body 301. On the side surface of the ink inflow tube 56L, there are erected the refrigerant relay pipe 65SL and the ink relay pipe 66SL so as to be arranged side by side in the Z-axis direction. The refrigerant relay pipe 65SL and the ink relay pipe 66SL are both guided from the inside (the main body part 400 side) of the cover main body 301 to the outside (the opposite side to the main body part 400) of the cover main body 301 so as to penetrate the side surface 341 (a bottom surface of the groove 331L) of the cover main body 301, and are connected to the ink inflow tube 56L. Similarly, on the side surface of the ink inflow tube 56R, there are erected the refrigerant relay pipe 65SR and the ink relay pipe 66SR so as to be arranged side by side in the Z-axis direction. The refrigerant relay pipe 65SR and the ink relay pipe 66SR are both guided from the inside of the cover main body 301 to the outside of the cover main body 301 so as to penetrate the side surface 341 (a bottom surface of the groove 331R) of the cover main body 301, and are connected to the ink inflow tube 56R. The other ends of the refrigerant relay pipes 65SL, 65SR are respectively connected to the joints 70SL, 70SR of the main body part 400. The other ends of the ink relay pipes 66SL, 66SR are respectively connected to the base joints 80SL, 80SR of the main body part 400. It should be noted that the ink inflow tube 56L and the ink inflow tube 56R are those branched from the single ink inflow tube 56 between the pressure pump 51P (FIG. 2A, FIG. 2B) and the head chip 403. Therefore, the flow of the ink from the ink tank 3 is divided into the ink inflow tube 56L and the ink inflow tube 56R, and is then further divided into the refrigerant relay pipe 65SL and the ink relay pipe 66SL and at the same time divided into the refrigerant relay pipe 65SR and the ink relay pipe 66SR.

As shown in FIG. 10B, the cover unit 402A has a cover main body 302, the ink outflow tubes 57L, 57R, the refrigerant relay pipes 65EL, 65ER, and the ink relay pipes 66EL, 66ER. The cover main body 302 includes a plug 312 for blocking an opening 322 (see FIG. 11B described later), and grooves 332L, 332R each extending in the Z-axis direction and arranged in the Y-axis direction. The ink outflow tubes 57L, 57R are respectively housed in the grooves 332L, 332R of the cover main body 302. On the side surface of the ink outflow tube 57L, there are erected the refrigerant relay pipe 65EL and the ink relay pipe 66EL so as to be arranged side by side in the Z-axis direction. The refrigerant relay pipe 65EL and the ink relay pipe 66EL are both guided from the inside (the main body part 400 side) of the cover main body 302 to the outside (the opposite side to the main body part 400) of the cover main body 302 so as to penetrate the side surface 342 (a bottom surface of the groove 332L) of the cover main body 302, and are connected to the ink outflow tube 57L. Similarly, on the side surface of the ink outflow tube 57R, there are erected the refrigerant relay pipe 65ER and the ink relay pipe 66ER so as to be arranged side by side in the Z-axis direction. The refrigerant relay pipe 65ER and the ink relay pipe 66ER are both guided from the inside of the cover main body 302 to the outside of the cover main body 302 so as to penetrate the side surface 342 (the bottom surface of the groove 332R) of the cover main body 302, and are connected to the ink outflow tube 57R. The other ends of the refrigerant relay pipes 65EL, 65ER are respectively connected to the joints 70EL, 70ER of the main body part 400. The other ends of the ink relay pipes 66EL, 66ER are respectively connected to the base joints 80EL, 80ER of the main body part 400. It should be noted that the ink outflow tube 57L and the ink outflow tube 57R are those merging into the single ink outflow tube 57 between the suction pump 52P (FIG. 2A) and the head chip 403. The ink having been supplied from the cover unit 401A to the main body part 400 inflows into the ink outflow tube 57L through the refrigerant relay pipe 65EL and the ink relay pipe 66EL, and at the same time inflows into the ink outflow pipe 57R through the refrigerant relay pipe 65ER and the ink relay pipe 66ER, in the cover unit 401A. Further, it is arranged that the ink having flowed into the ink outflow tube 57L and the ink having flowed into the ink outflow tube 57R further inflow into the single ink outflow tube 57. Further, it is also possible to make the cover main body 301 and the cover main body 302 have the same structure.

(Cover Units 401B, 402B)

Figure 11A:
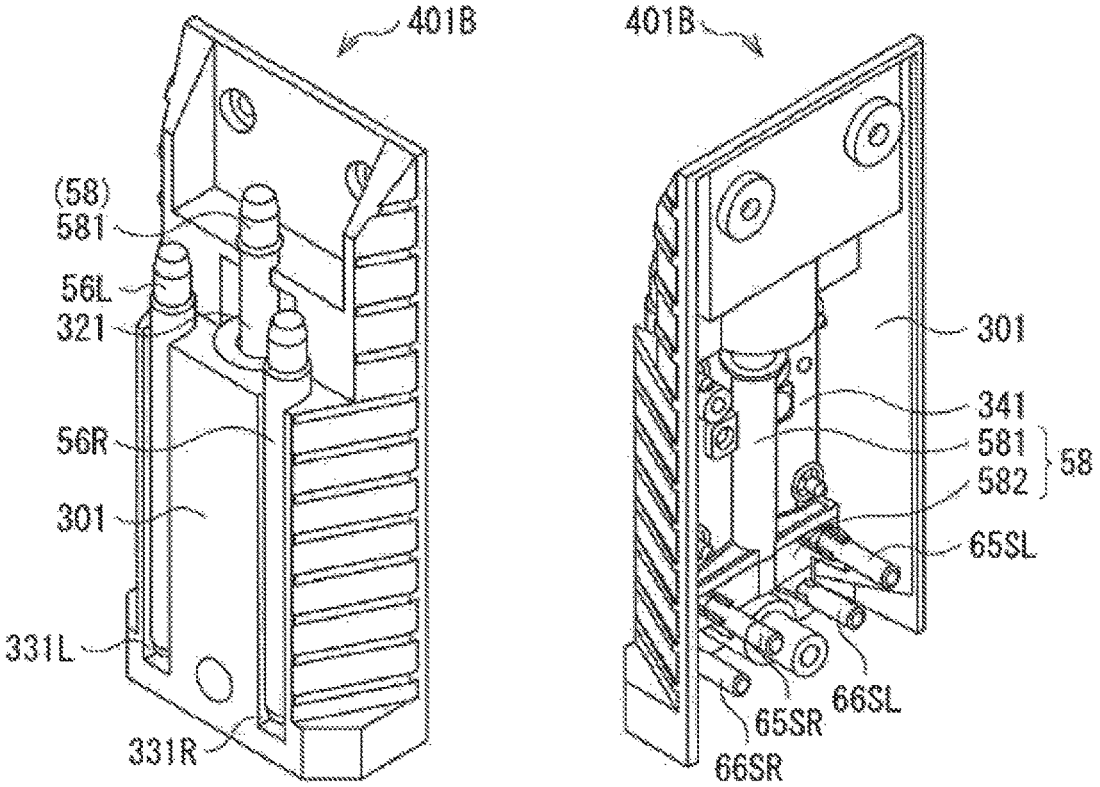
FIG. 11A is a perspective view showing a second inflow side cover unit included in the liquid jet head shown in FIG. 1.
Figure 11B:
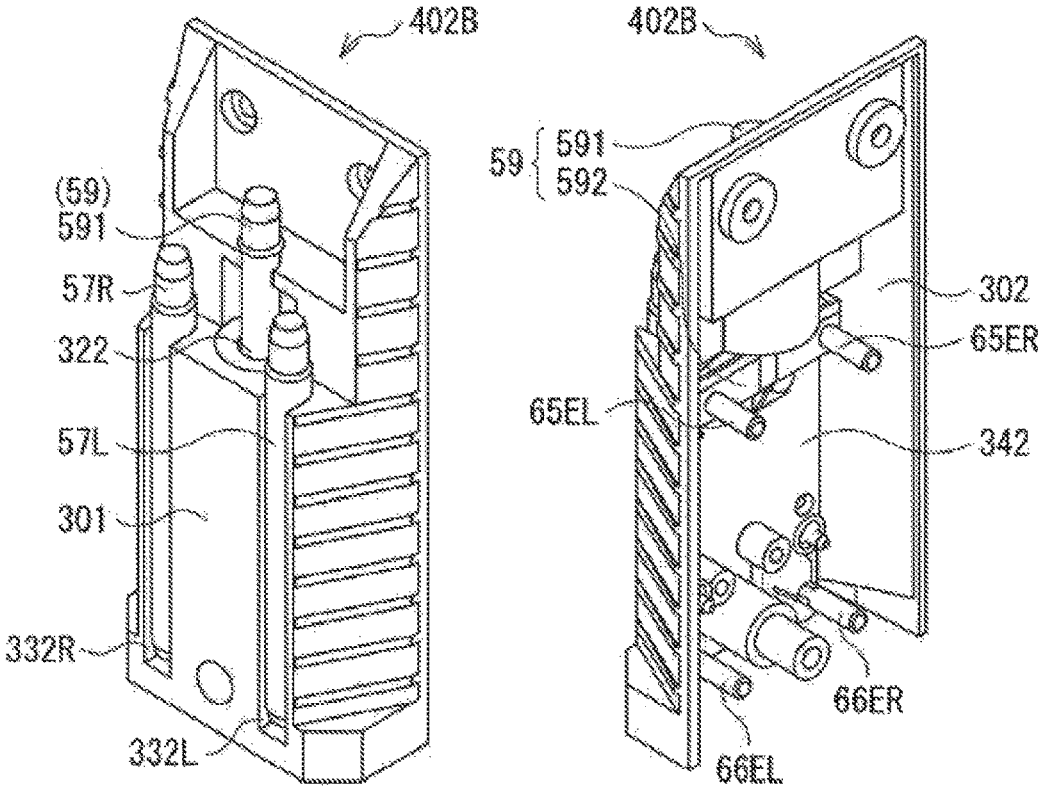
FIG. 11B is a perspective view showing a second outflow side cover unit included in the liquid jet head shown in FIG. 1.

FIG. 11A is a perspective view showing a configuration of the cover unit 401B. The diagram on the left side of FIG. 11A shows the state of the cover unit 401B viewed from the outside (the opposite side to the side to be mounted on the main body part 400), and the diagram on the right side of FIG. 11A is a perspective view showing the state of the cover unit 401B viewed from the inside (the side to be mounted on the main body part 400). Further, FIG. 11B is a perspective view showing a configuration of the cover unit 402B. The diagram on the left side of FIG. 11B shows the state of the cover unit 402B viewed from the outside, and the diagram on the right side of FIG. 11B is a perspective view showing the state of the cover unit 402B viewed from the inside.

As shown in FIG. 11A, the cover unit 401B has the cover main body 301, the refrigerant inflow tube 58, the ink inflow tubes 56L, 56R, the refrigerant relay pipes 65SL, 65SR, and the ink relay pipes 66SL, 66SR. Although the cover main body 301 has substantially the same structure as that of the cover unit 401A shown in FIG. 10A, the plug 311 for blocking the opening 321 is removed, and the refrigerant inflow tube 58 is attached to the cover main body 301 so as to penetrate the opening 321. The refrigerant inflow tube 58 has a main part 581 extending in the Z-axis direction, and a branch part 582 connected to the main part 581 and extending in the Y-axis direction. One ends of the refrigerant relay pipes 65SL, 65SR are respectively connected to the vicinities of the both ends of the branch part 582. The other ends of the refrigerant relay pipes 65SL, 65SR are respectively connected to the joints 70SL, 70SR (see FIG. 5A) of the main body part 400. Therefore, the flow of the refrigerant from the refrigerant tank 7 is divided into the refrigerant relay pipe 65SL and the refrigerant relay pipe 65SR from the refrigerant inflow tube 58 in the cover unit 401B, and is then guided respectively to the cooling section 404L and the cooling section 404R. In other words, it is arranged that the refrigerant from the refrigerant relay pipe 65SL is supplied to the cooling section 404L through the joint 70SL, and the refrigerant from the refrigerant relay pipe 65SR is supplied to the cooling section 404R through the joint 70SR.

The ink inflow tubes 56L, 56R are respectively housed in the grooves 331L, 331R of the cover main body 301. On the side surface of the ink inflow tube 56L, there is erected the ink relay pipe 66SL, and on the side surface of the ink inflow pipe 56R, there is erected the ink relay pipe 66SR. The ink relay pipes 66SL, 66SR are both guided from the inside of the cover main body 301 to the outside of the cover main body 301 so as to penetrate the side surface 341 (the bottom surfaces of the grooves 331L, 331R) of the cover main body 301, and are connected respectively to the ink inflow tubes 56L, 56R. The other ends of the ink relay pipes 66SL, 66SR are respectively connected to the base joints 80SL, 80SR of the main body part 400. It should be noted that the ink inflow tube 56L and the ink inflow tube 56R are those branched from the single ink inflow tube 56 between the pressure pump 51P (FIGS. 2A and 2B) and the inkjet head 4. Therefore, the flow of the ink from the ink tank 3 is divided in to the ink inflow tube 56L and the ink inflow tube 56R, and is then guided to the main body part 400 passing respectively through the ink relay pipe 66SL and the ink relay pipe 66SR. It is arranged that the ink from the ink relay pipe 66SL is supplied to the head chip 403 through the base joint 80SL, and the ink from the ink relay pipe 66SR is supplied to the head chip 403 through the base joint 80SR.

As shown in FIG. 11B, the cover unit 402B has the cover main body 302, the refrigerant outflow tube 59, the ink outflow tubes 57L, 57R, the refrigerant relay pipes 65EL, 65ER, and the ink relay pipes 66EL, 66ER. Although the cover main body 302 has substantially the same structure as that of the cover unit 402A shown in FIG. 10B, the plug 312 for blocking the opening 322 is removed, and the refrigerant outflow tube 59 is attached to the cover main body 302 so as to penetrate the opening 322. The refrigerant outflow tube 59 has a main part 591 extending in the Z-axis direction, and a branch part 592 connected to the main part 591 and extending in the Y-axis direction. One ends of the refrigerant relay pipes 65EL, 65ER are respectively connected to the vicinities of the both ends of the branch part 592. The other ends of the refrigerant relay pipes 65EL, 65ER are respectively connected to the joints 70EL, 70ER (see FIG. 5A) of the main body part 400.

The ink outflow tubes 57L, 57R are respectively housed in the grooves 332L, 332R of the cover main body 302. On the side surface of the ink outflow tube 57L, there is erected the ink relay pipe 66EL, and on the side surface of the ink outflow pipe 57R, there is erected the ink relay pipe 66ER. The ink relay pipes 66EL, 66ER are both guided from the inside of the cover main body 302 to the outside of the cover main body 302 so as to penetrate the side surface 342 (the bottom surfaces of the grooves 332L, 332R) of the cover main body 302, and are connected respectively to the ink outflow tubes 57L, 57R. The other ends of the ink relay pipes 66EL, 66ER are respectively connected to the base joints 80EL, 80ER of the main body part 400. It should be noted that the ink outflow tube 57L and the ink outflow tube 57R are those merging into the single ink outflow tube 57 between the suction pump 52P (FIG. 2B) and the head chip 403. The ink having been supplied from the cover unit 401B to the main body part 400 inflows into the ink outflow tube 57L through the ink relay pipe 66EL, and at the same time inflows into the ink outflow pipe 57R through the ink relay pipe 66ER in the cover unit 402B. It is arranged that subsequently, the ink having flowed into the ink outflow tube 57L and the ink having flowed into the ink outflow tube 57R further inflow into the single ink outflow tube 57.

As described above, in the present embodiment, the relative positions between the tip parts (refrigerant inflow port connection end parts to be inserted into the joints 70SL, 70SR) of the refrigerant relay pipes 65SL, 65SR and the tip parts (liquid inflow port connection end parts to be inserted into the base joints 80SL, 80SR) of the ink relay pipes 66SL, 66SR in the cover unit 401A are substantially the same as the relative positions between the tip parts of the refrigerant relay pipes 65SL, 65SR and the tip parts of the ink relay pipes 66SL, 66SR in the cover unit 401B. Similarly, the relative positions between the tip parts (refrigerant outflow port connection end parts to be inserted into the joints 70EL, 70ER) of the refrigerant relay pipes 65EL, 65ER and the tip parts (refrigerant outflow port connection end parts to be inserted into the base joints 80EL, 80ER) of the ink relay pipes 66EL, 66ER in the cover unit 402A are substantially the same as the relative positions between the tip parts of the refrigerant relay pipes 65EL, 65ER and the tip parts of the ink relay pipes 66EL, 66ER in the cover unit 402B.

It should be noted that in the inkjet head 4, the cover unit 402A is mounted in the case of mounting the cover unit 401A on the main body part 400, and the cover unit 402B is mounted in the case of mounting the cover unit 401B on the main body part 400.

(Head Chip 403)

Figure 12:
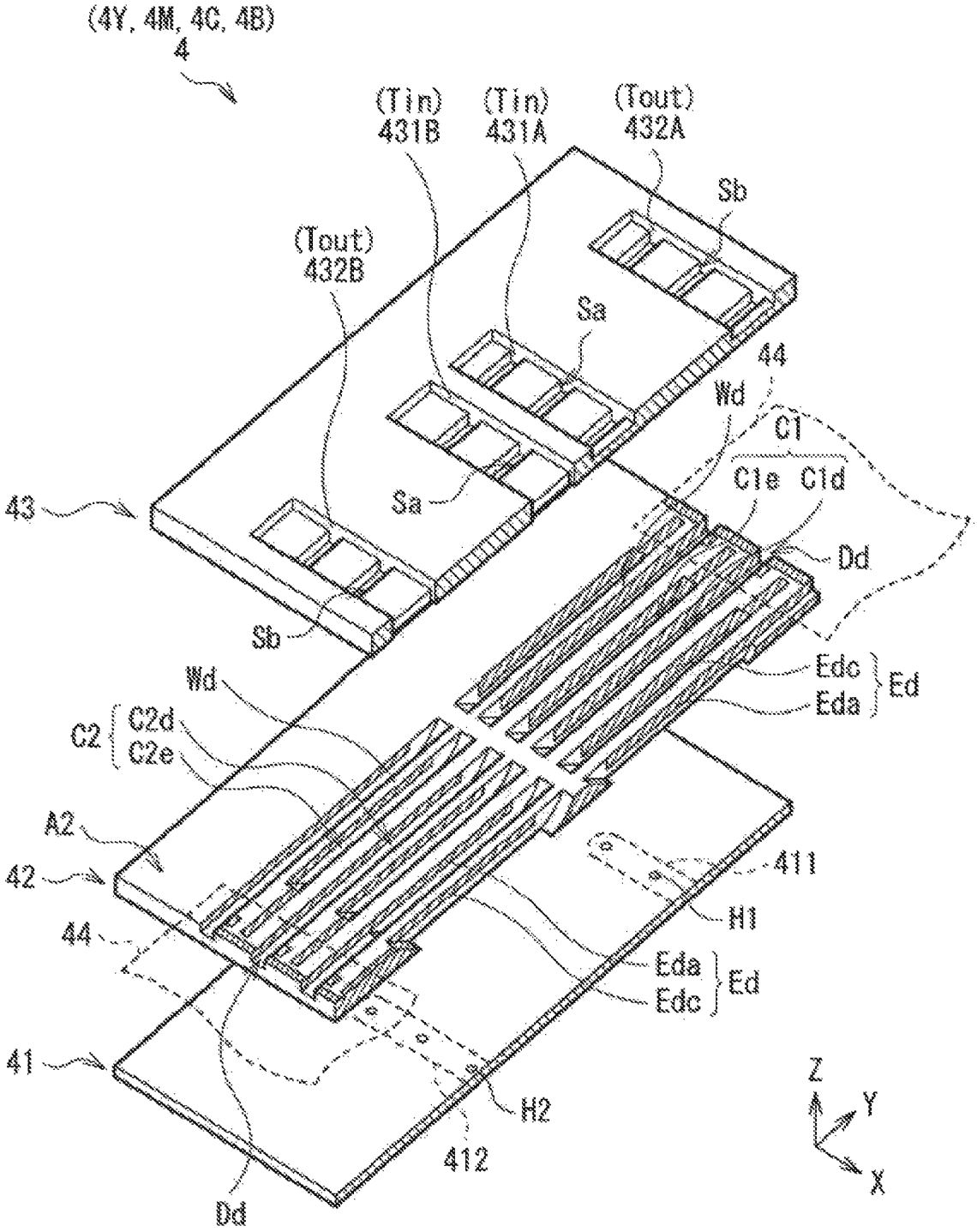
FIG. 12 is an exploded perspective view of the liquid jet head shown in FIG. 1.
Figure 13:
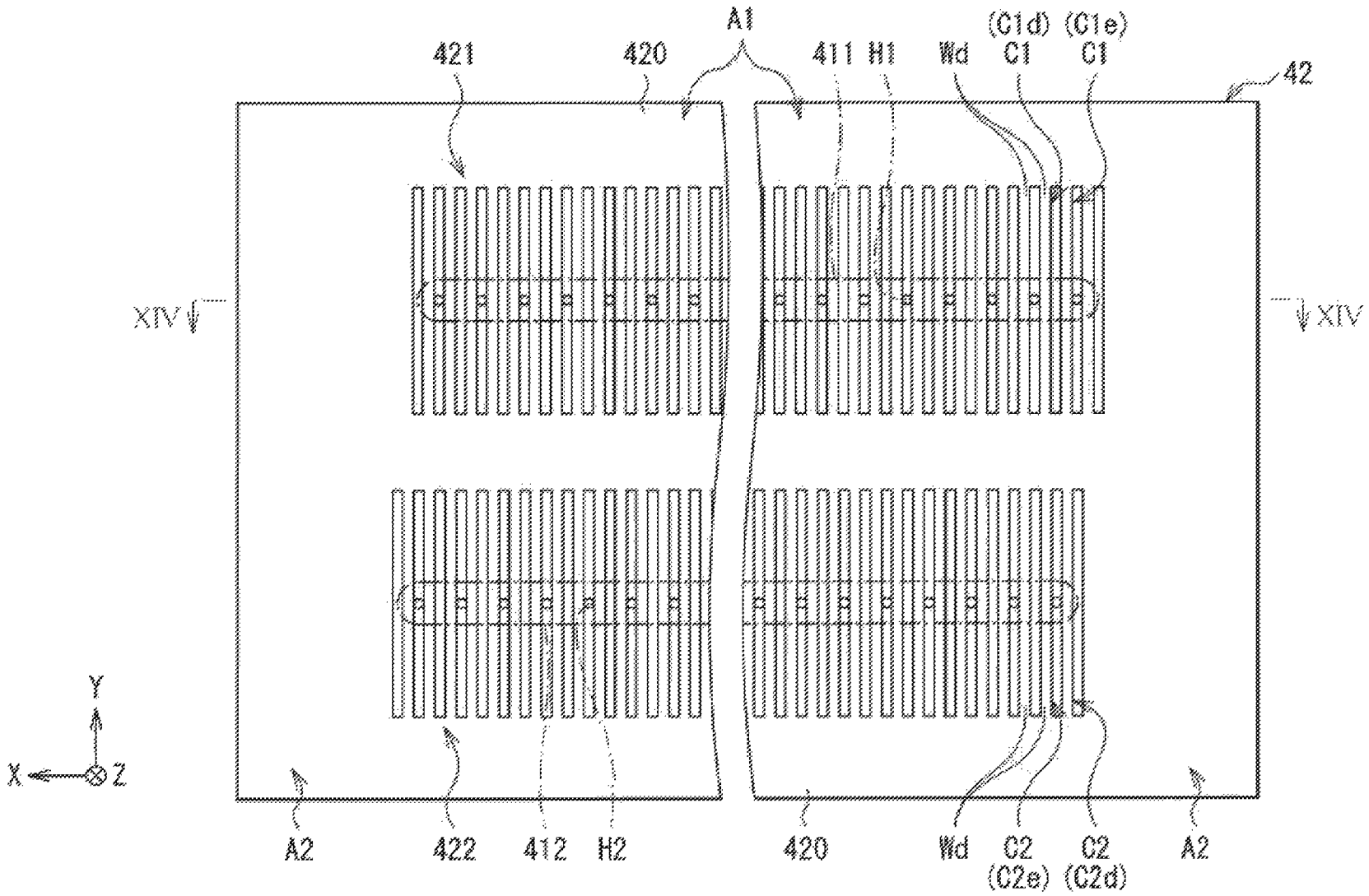
FIG. 13 is a plan view of the liquid jet head shown in FIG. 1.
Figure 14:
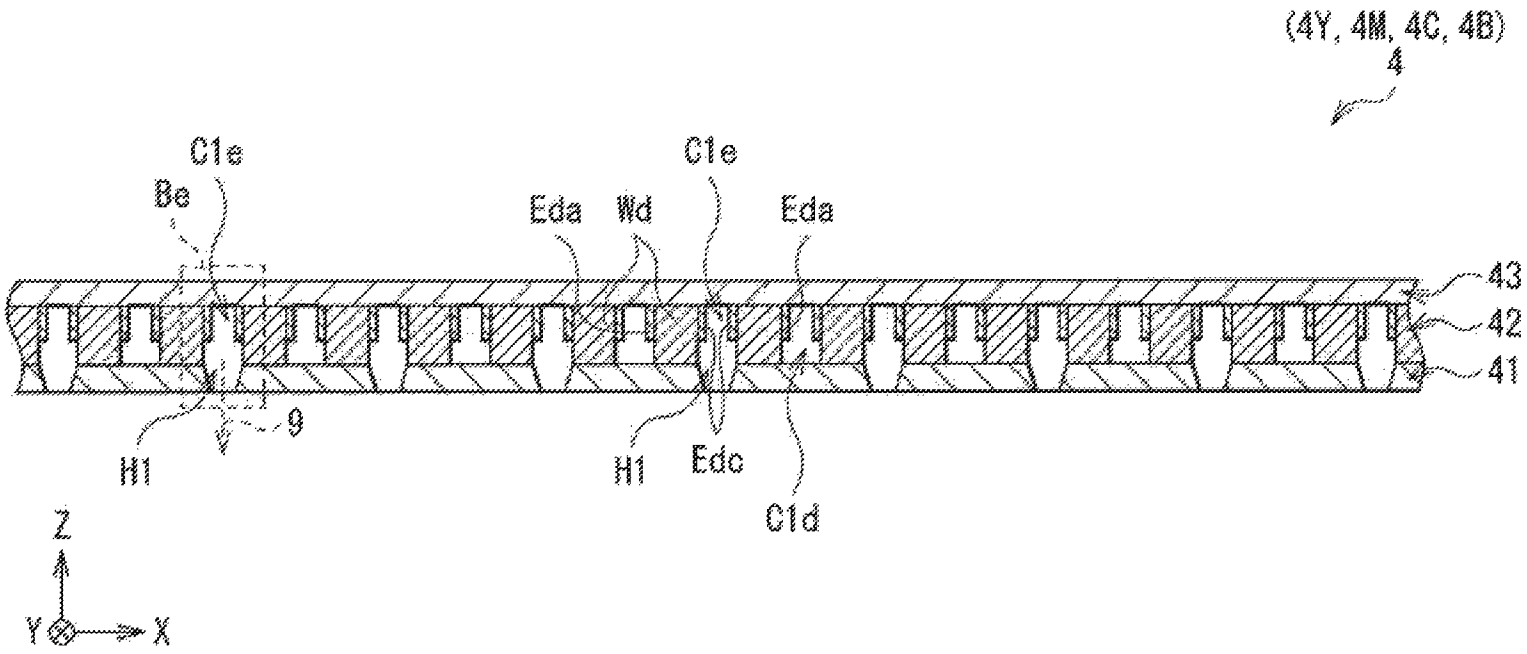
FIG. 14 is a cross-sectional view of the liquid jet head shown in FIG. 1.

FIG. 12 is an exploded perspective view showing a detailed configuration example of the head chip 403. FIG. 13 is a bottom view (an X-Y bottom view) schematically showing a configuration example of the head chip 403 in the state in which a nozzle plate 41 (a jet hole plate) shown in FIG. 12 is detached. FIG. 14 is a diagram schematically showing a cross-sectional configuration example (a Z-X cross-sectional configuration example) along the line XIV-XIV shown in FIG. 13. It should be noted that in FIG. 12 and FIG. 13, a half in the Y-axis direction of the head chip 403, namely a part of the area where the ink chambers 431A, 432A, 431B, and 432B are formed, is shown in an enlarged manner. Since the area where the ink chambers 431C, 432C, 431D, and 432D are formed in the head chip 403 also has the structure shown in FIG. 12 and FIG. 13 in essence, the description thereof will hereinafter be omitted.

As shown in FIG. 12, the head chip 403 is mainly provided with the nozzle plate 41, an actuator plate 42 and the cover plate 43. The nozzle plate 41, the actuator plate 42 and the cover plate 43 are bonded to each other using, for example, an adhesive, and are stacked on one another in this order along the Z-axis direction. It should be noted that the description will hereinafter be presented with the cover plate 43 side along the Z-axis direction referred to as an upper side, and the nozzle plate 41 side referred to as a lower side.

<Nozzle Plate 41>

The nozzle plate 41 is formed of a film member made of polyimide or the like having a thickness of, for example, about 50 μm, and is bonded to a lower surface of the actuator plate 42 as shown in FIG. 12. Further, although the nozzle plate 41 is provided with four nozzle columns (nozzle columns 411 through 414) each extending along the X-axis direction in reality as shown in FIG. 8C, the nozzle columns 411, 412 among those are shown alone in FIG. 12 and FIG. 13. These nozzle columns 411 through 414 are arranged along the Y-axis direction at predetermined intervals (FIG. 8C).

The nozzle column 411 has a plurality of nozzles H1 formed in alignment with each other at predetermined intervals along the X-axis direction. These nozzles H1 each penetrate the nozzle plate 41 along the thickness direction (the Z-axis direction) of the nozzle plate 41, and are communicated with the respective ejection channels C1*e* in the actuator plate 42 as shown in, for example, FIG. 14. Specifically, as shown in FIG. 13, each of the nozzles H1 is formed so as to be located in a central part along the Y-axis direction on the ejection channel C1*e*. Further, the formation pitch along the X-axis direction in the nozzles H1 is made equal (equal in pitch) to the formation pitch along the X-axis direction in the ejection channels C1*e*. Although the details will be described later, it is arranged that the ink supplied from the inside of the ejection channel C1*e* is ejected (jetted) from each of the nozzles H1 in such a nozzle column 411.

The nozzle column 412 similarly has a plurality of nozzles H2 formed in alignment with each other at predetermined intervals along the X-axis direction. Each of these nozzles H2 also penetrates the nozzle plate 41 along the thickness direction of the nozzle plate 41, and is communicated with the ejection channel C2*e* in the actuator plate 42 described later. Specifically, as shown in FIG. 13, each of the nozzles H2 is formed so as to be located in a central part along the Y-axis direction on the ejection channel C2*e*. Further, the formation pitch along the X-axis direction in the nozzles H2 is made equal to the formation pitch along the X-axis direction in the ejection channels C2*e*. Although the details will be described later, it is arranged that the ink supplied from the inside of the ejection channel C2*e* is also ejected from each of the nozzles H2 in such a nozzle column 412. It should be noted that these nozzles H1, H2 are each formed as a tapered through hole gradually decreasing in diameter in a downward direction.

<Actuator Plate 42>

The actuator plate 42 is a plate formed of a piezoelectric material such as lead zirconate titanate (PZT). In the actuator plate 42, the polarization direction is set to one direction along the thickness direction (the Z-axis direction). Further, although the actuator plate 42 is provided with four channel columns each extending along the X-axis direction in reality, the two channel columns 421, 422 among those are shown alone in FIG. 12 and FIG. 13. These channel columns 421, 422 are arranged along the Y-axis direction at predetermined intervals.

In such an actuator plate 42, as shown in FIG. 13, an ejection area (jetting area) A1 of the ink is disposed in a central part (the formation areas of the channel columns 421, 422) along the X-axis direction. On the other hand, in the actuator plate 42, a non-ejection area (a non-jetting area) A2 of the ink is disposed in each of the both end parts (non-formation areas of the channel columns 421, 422) along the X-axis direction. The non-ejection areas A2 are located on the outer side along the X-axis direction with respect to the ejection area A1. It should be noted that the both end parts along the Y-axis direction in the actuator plate 42 each constitute a tail part 420.

As shown in FIG. 12 and FIG. 13, the channel column 421 described above has the plurality of channels C1 extending along the Y-axis direction. These channels C1 are arranged side by side so as to be parallel to each other at predetermined intervals along the X-axis direction. Each of the channels C1 is partitioned with drive walls Wd formed of a piezoelectric body (the actuator plate 42), and forms a groove section having a recessed shape in a cross-sectional view.

The channel column 422 similarly has the plurality of channels C2 extending along the Y-axis direction. These channels C2 are arranged side by side so as to be parallel to each other at predetermined intervals along the X-axis direction. Each of the channels C2 is also partitioned with the drive walls Wd described above, and forms a groove section having a recessed shape in a cross-sectional view.

Here, as shown in FIG. 12 and FIG. 13, in the channels C1, there exist the ejection channels C1*e* for ejecting the ink, and dummy channels C1*d* not ejecting the ink. In the channel column 421, the ejection channels C1*e* and the dummy channels C1*d* are alternately arranged along the X-axis direction. Each of the ejection channels C1*e* is communicated with the nozzle H1 in the nozzle plate 41 on the one hand, but each of the dummy channels C1*d* is not communicated with the nozzle H1, and is covered with the upper surface of the nozzle plate 41 from below on the other hand.

Similarly, in the channels C2, there exist the ejection channels C2*e* for ejecting the ink, and dummy channels C2*d* not ejecting the ink. In the channel column 422, the ejection channels C2*e* and the dummy channels C2*d* are alternately arranged along the X-axis direction. Each of the ejection channels C2*e* is communicated with the nozzle H2 in the nozzle plate 41 on the one hand, but each of the dummy channels C2*d* is not communicated with the nozzle H2, and is covered with the upper surface of the nozzle plate 41 from below on the other hand.

Further, as shown in FIG. 13, the ejection channels C1*e* and the dummy channels C1*d* in the channels C1 and the ejection channels C2*e* and the dummy channels C2*d* in the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. It should be noted that as shown in FIG. 12, in the actuator plate 42, in the part corresponding to each of the dummy channels C1*d*, C2*d*, there is formed a shallow groove section Dd communicated with an outside end part extending along the Y-axis direction in the dummy channel C1*d*, C2*d*.

Here, as shown in FIG. 12 and FIG. 14, drive electrodes Ed extending along the Y-axis direction are disposed on the inner side surfaces opposed to each other in each of the drive walls Wd described above. As the drive electrodes Ed, there exist common electrodes Edc disposed on the inner side surfaces facing the ejection channels C1*e*, C2*e*, and active electrodes Eda disposed on the inner side surfaces facing the dummy channels C1*d*, C2*d*. It should be noted that each of such drive electrodes Ed (the common electrodes Edc and the active electrodes Eda) is not formed beyond an intermediate position in the depth direction (the Z-axis direction) on the inner side surface of the drive wall Wd as shown in FIG. 14.

The pair of common electrodes Edc opposed to each other in the same ejection channel C1*e* (or the same ejection channel C2*e*) are electrically connected to each other in a common terminal (not shown). Further, the pair of active electrodes Eda opposed to each other in the same dummy channel C1*d* (or the same dummy channel C2*d*) are electrically separated from each other. In contrast, the pair of active electrodes Eda opposed to each other via the ejection channel C1*e* (or the ejection channel C2*e*) are electrically connected to each other in an active terminal (not shown).

Here, in the tail part 420 described above, there is mounted a flexible printed circuit board 44 for electrically connecting the drive electrodes Ed and the control circuit 430 (FIG. 4A) to each other as shown in FIG. 12. Interconnection patterns (not shown) provided to the flexible printed circuit board 44 are electrically connected to the common terminals and the active terminals described above. Thus, it is arranged that the drive voltage is applied to each of the drive electrodes Ed from the control circuit 430 via the flexible printed circuit board 44.

<Cover Plate 43>

As shown in FIG. 12, the cover plate 43 is disposed so as to close the channels C1, C2 (the channel columns 421, 422) in the actuator plate 42. Specifically, the cover plate 43 is bonded to the upper surface of the actuator plate 42, and has a plate-like structure.

As shown in FIG. 12, the cover plate 43 is provided with a pair of ink chambers 431A, 432A and a pair of ink chambers 431B, 432B. Specifically, the pair of ink chambers 431A, 432A are formed in the area corresponding to the channel column 421 (the plurality of channels C1) in the actuator plate 42. Further, the pair of ink chambers 431B, 432B are formed in the area corresponding to the channel column 422 (the plurality of channels C2) in the actuator plate 42.

The ink chamber 431A is formed in the vicinity of an inner end part along the Y-axis direction in each of the channels C1, and forms a groove section having a recessed shape. In areas corresponding respectively to the ejection channels C1*e* in the ink chamber 431A, there are respectively formed supply slits Sa penetrating the cover plate 43 along the thickness direction (the Z-axis direction) of the cover plate 43. Similarly, the ink chamber 431B is formed in the vicinity of an inner end part along the Y-axis direction in each of the channels C2, and forms a groove section having a recessed shape. In this ink chamber 431B, the area corresponding to each of the ejection channels C2*e* is also provided with the supply slit Sa described above.

As shown in FIG. 12, the ink chamber 432A is formed in the vicinity of an outer end part along the Y-axis direction in each of the channels C1, and forms a groove section having a recessed shape. In areas corresponding respectively to the ejection channels C1*e* in the ink chamber 432A, there are respectively formed discharge slits Sb penetrating the cover plate 43 along the thickness direction of the cover plate 43. Similarly, the ink chamber 432B is formed in the vicinity of an outer end part along the Y-axis direction in each of the channels C2, and forms a groove section having a recessed shape. In this ink chamber 432B, the area corresponding to each of the ejection channels C2*e* is also provided with the discharge slit Sb described above.

In such a manner, the ink chamber 431A and the ink chamber 432A are each communicated with the ejection channel C1*e* via the supply slit Sa and the discharge slit Sb on the one hand, but are not communicated with the dummy channels C1*d* on the other hand. Specifically, each of the dummy channels C1*d* is arranged to be closed by bottom parts of the ink chamber 431A and the ink chamber 432A.

Similarly, the ink chamber 431B and the ink chamber 432B are each communicated with the ejection channel C2*e* via the supply slit Sa and the discharge slit Sb on the one hand, but are not communicated with the dummy channels C2*d* on the other hand. Specifically, each of the dummy channels C2*d* is arranged to be closed by bottom parts of the ink chamber 431B and the ink chamber 432B.

[Operations]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink of the corresponding colors (the four colors), respectively. Further, there is achieved the state in which the inkjet heads 4 are filled with the ink in the ink tanks 3 via the circulation mechanism 5, respectively.

In the printer 1, it is possible to arbitrarily perform switching between a first mode in which the cover units 401A, 402A are mounted on the main body part 400 and a second mode in which the cover units 401B, 402B are mounted on the main body part 400. The first mode is a mode for circulating the ink between the ink tank 3, the head chip 403 and the cooling sections 404 using the circulation mechanism 5. In other words, the first mode is a mode for using the ink not only as a raw material for printing but also as a refrigerant for cooling the control circuit 430 and so on. In contrast, the second mode is a mode for circulating the ink between the ink tank 3 and the head chip 403, and at the same time circulating the refrigerant between the refrigerant tank 7 and the cooling sections 404 using the circulation mechanism 5. In other words, the second mode is a mode for cooling the control circuit 430 and so on by circulating the refrigerant different from the ink independently of the circulation of the ink.

In the first mode shown in FIG. 2A, the pressure pump 51P and the suction pump 52P are operated in the state in which the cover units 401A, 402A are mounted on the main body part 400. Thus, the ink in the ink tank 3 is fed to the head chip 403 and the cooling sections 404 passing through the ink supply tube 51, the ink inflow tubes 56, the ink relay pipes 66S and the refrigerant relay pipes 65S in sequence, and then the ink is returned to the ink tank 3 further passing through the ink relay pipes 66E and the refrigerant relay pipes 65E, the ink outflow tubes 57 and the ink discharge tube 52 in sequence.

In contrast, in the second mode shown in FIG. 2B, the pressure pumps 51P, 53P and the suction pumps 52P, 54P are operated in the state in which the cover units 401B, 402B are mounted on the main body part 400. Thus, the ink in the ink tank 3 is fed to the head chip 403 passing through the ink supply tube 51, the ink inflow tubes 56, and the ink relay pipes 66S in sequence, and then the ink is returned to the ink tank 3 further passing through the ink relay pipes 66E, the ink outflow tubes 57 and the ink discharge tube 52 in sequence. Further, the refrigerant in the refrigerant tank 7 is fed to the cooling sections 404 passing through the refrigerant supply tube 53, the refrigerant inflow tube 58 and the refrigerant relay pipes 65S in sequence, and then the refrigerant is returned to the refrigerant tank 7 further passing through the refrigerant relay pipes 65E, the refrigerant outflow tube 59 and the refrigerant discharge tube 54 in sequence.

It is sufficient for the switching between the first mode and the second mode to arbitrarily be selected in accordance with, for example, the physicality of the ink used. Specifically, in the case in which the ink can be used at the temperature suitable as the refrigerant such as the case in which the ink has relatively low viscosity at room temperature and is not required to be heated when performing the recording operation, it is sufficient to select the first mode. In contrast, in the case in which the ink has relatively high viscosity at room temperature, and is required to be heated when performing the printing operation, it is sufficient to select the second mode. It should be noted that in the case of mounting the cover units 401A, 402A on the main body part 400, the refrigerant relay pipes 65S, 65E and the ink relay pipes 66S, 66E are respectively connected to the joints 70 and the base joints 80, and at the same time, the ink supply tube 51 and the ink discharge tube 52 are respectively connected to the ink inflow tubes 56 and the ink outflow tubes 57. Further, in the case of mounting the cover units 401B, 402B on the main body part 400, the refrigerant supply tube 53 and the refrigerant discharge tube 54 are respectively connected to the refrigerant inflow tube 58 and the refrigerant outflow tube 59 in addition to the above. After the exchange, by sufficiently circulating the ink (and the refrigerant), there is created the state in which the inkjet head 4 is sufficiently filled with the desired ink (and the refrigerant).

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Heads 4)

Then, the detailed operation (the jet operation of the ink) in the inkjet head 4 will be described with reference to FIGS. 1, 2, 12 through 14 and so on. Specifically, in the inkjet heads 4 (the side-shoot type, the circulation type inkjet heads) according to the present embodiment, the jet operation of the ink using a shear mode is performed in the following manner.

Firstly, when the reciprocation of the carriage 62 (see FIG. 1) described above is started, a control section applies the drive voltages to the drive electrodes Ed (the common electrodes Edc and the active electrodes Eda) in the inkjet head 4 via the flexible printed circuit board 44. Specifically, the control section 40 applies the drive voltage to the drive electrodes Ed disposed on the pair of drive walls Wd forming the ejection channel C1*e*, C2*e*. Thus, the pair of drive walls Wd each deform (see FIG. 14) so as to protrude toward the dummy channel C1*d*, C2*d* adjacent to the ejection channel C1*e*, C2*e*.

Here, as described above, in the actuator plate 42, the polarization direction is set to the one direction, and at the same time, the drive electrodes Ed are not formed beyond the intermediate position in the depth direction on the inner side surfaces in the drive walls Wd. Therefore, by applying the drive voltage using the control section 40, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e*, C2*e* increases. Further, due to the increase of the capacity of the ejection channel C1*e*, C2*e*, it results that the ink retained in the entrance side common ink chamber 431*a*, 432*a* is induced into the ejection channel C1*e*, C2*e* (see FIG. 12).

Subsequently, the ink having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle H1, H2 of the nozzle plate 41. Thus, the drive walls Wd are restored from the state of the flexion deformation described above, and as a result, the capacity of the ejection channel C1*e*, C2*e* having once increased is restored again (see FIG. 14).

When the capacity of the ejection channel C1*e*, C2*e* is restored in such a manner, the internal pressure of the ejection channel C1*e*, C2*e* increases, and the ink in the ejection channel C1*e*, C2*e* is pressurized. As a result, the ink having a droplet shape is ejected (see FIG. 14) toward the outside (toward the recording paper P) through the nozzle H1, H2. The jet operation (the ejection operation) of the ink in the inkjet head 4 is performed in such a manner, and as a result, the recording operation of images, characters, and so on to the recording paper P is performed.

In particular, the nozzles H1, H2 of the present embodiment each have the tapered shape gradually decreasing in diameter in the downward direction (see FIG. 14) as described above, and can therefore eject the ink straight (good in straightness) at high speed. Therefore, it becomes possible to perform recording high in image quality.

[Functions and Advantages]

Then, the functions and the advantages in the inkjet head 4 and the printer 1 according to the present embodiment will be described in detail.

In the present embodiment, the cover unit 401A and the cover unit 401B can selectively be attached and detached on the inflow side of the main body part 400. Here, the cover unit 401A includes the ink inflow tubes 56 branched into the ink relay pipes 66S which can be connected to the base joints 80S provided to the inflow holes 471 of the inside flow channel plate 47 (the liquid flow channel), and the refrigerant relay pipes 65S which can be connected to the refrigerant inflow ports 407S via the joints 70S. Further, the cover unit 401B includes the ink inflow tubes 56 connected to the ink relay pipes 66S which can be connected to the base joints 80S provided to the inflow holes 471, and the refrigerant inflow tubes 58 connected to the refrigerant relay pipes 65S which can be connected to the refrigerant inflow ports 407S via the joints 70S as separated bodies. Further, in the present embodiment, it is arranged that the cover unit 402A and the cover unit 402B can selectively be attached and detached on the outflow side of the main body part 400. Here, the cover unit 402A includes the ink outflow tubes 57 where the ink relay pipes 66E which can be connected to the base joints 80E provided to the outflow holes 472 of the inside flow channel plate 47 (the liquid flow channel), and the refrigerant relay pipes 65E which can be connected to the refrigerant outflow ports 407E via the joints 70E are merged with each other. Further, the cover unit 402B includes the ink outflow tubes 57 connected to the ink relay pipes 66E which can be connected to the base joints 80E provided to the outflow holes 472, and the refrigerant outflow tubes 59 connected to the refrigerant relay pipes 65E which can be connected to the refrigerant outflow ports 407E via the joints 70E as separated bodies. Due to such a configuration, in the present embodiment, by appropriately selecting and mounting the appropriate cover units 401, 402 in accordance with the usage and the aptitude such as the physicality of the ink, it is possible to perform the jet of a variety of types of liquid (ink) without changing the main body part 400. For example, if the cover units 401A, 402A are selected, it is possible to supply the ink to the liquid flow channel of the head chip 403, and at the same time supply the ink to the refrigerant flow channels of the cooling sections 404 as the refrigerant. In contrast, if the cover units 401B, 402B are selected, it is possible to supply the ink to the liquid flow channel of the head chip 403, and at the same time supply the refrigerant other than the ink to the refrigerant flow channels of the cooling sections 404. Therefore, according to the inkjet head 4 and the printer 1 of the present embodiment, it is possible to deal with the jet of a variety of types of ink by changing only the cover units 401, 402, and it is possible to ensure the excellent handling.

Further, in the present embodiment, it is arranged that each of the cooling sections 404 has the cooling pipe 407 for forming the refrigerant flow channel, and the cooling plates 408, 409 having contact with the outer surface of the cooling pipe 407, the cooling pipe 407 is made of the corrosion-resistant material having the corrosion resistance to the ink, and the cooling plates 408, 409 are made of the highly heat-conductive material having the higher thermal conductivity than the thermal conductivity of the corrosion-resistant material of the cooling pipe 407. The corrosion-resistant material is, for example, stainless steel, and the highly heat-conductive material is, for example, an aluminum simple substance or an aluminum alloy. By providing such a configuration, it is possible to obtain high cooling efficiency while avoiding the corrosion by the ink. Therefore, the present embodiment is advantageous to miniaturization of the inkjet head 4, and by extension to miniaturization of the printer 1.

Further, in the present embodiment, the cooling pipe 407 is installed so that the height position of the refrigerant inflow port 407S of the cooling pipe 407 becomes lower than the height position of the refrigerant outflow port 407E of the cooling pipe 407 in the vertical direction. According to this configuration, the refrigerant inflow port 407S is located on the lower side in the vertical direction of the refrigerant outflow port 407E in the posture in which the inkjet head 4 is installed as a result. Therefore, when supplying the refrigerant to the cooling pipe 407, it becomes difficult for the bubbles to enter the cooling pipe 407, and it is possible to obtain higher cooling efficiency.

Further, in the present embodiment, there is provided the outside sleeve 74 having a ring-like shape including the opening 74K in which the refrigerant relay pipe 65S, 65E as a refrigerant relay path is inserted, and in the detached state in which the refrigerant relay pipe 65S, 65E is detached, the outside diameter D65 of the refrigerant relay pipe 65S, 65E is larger than the inside diameter D74E of the inside end part 74E, and is smaller than the inside diameter D74S of the outside end part 74S of the outside sleeve 74. Further, the outside end part 74S of the outside sleeve 74 has the thick wall part 74S1 and the thin wall part 74S2 located on an inner side (a position close to the inside end part 74E) of the thick wall part 74S1, and the thickness T1 of the thick wall part 74S1 is thicker than the thickness T2 of the thin wall part 74S2 (T1>T2). Due to the presence of the thick wall part 74S1, it is possible to effectively prevent the ink and the refrigerant from being leaked from the connection place (the joint 70) between the main body part 400 and the cover unit 401, 402. Further, due to the presence of the thin wall part 74S2, since the outside diameter of the refrigerant relay pipe 65S, 65E to be inserted into the opening 74K is smaller than the inside diameter of the outside end part 74S of the outside sleeve 74, even if some displacement exists between the joint 70 and the refrigerant relay pipe 65S, 65E, the error thereof can be absorbed. Further, since the duckbill valve is adopted as the inside end part 74E of the outside sleeve 74 and the inside end part of the sleeve 82, it is possible to prevent dripping of the ink and the refrigerant from the main body part 400 in the state in which the cover units 401, 402 are detached.

Further, in the present embodiment, it is arranged that the ink inflow tubes 56 and the ink outflow tubes 57 are guided from the inside of the cover main body 301, 302 to the outside of the cover main body 301, 302 through the side surface 341, 342. Therefore, it is possible to prevent the ink leaked when replacing the cover units 401, 402 from contaminating the inside of the cover main body 301, 302 and the vicinity of the joint 70, 80 compared to the case in which, for example, the ink inflow tubes 56 and the ink outflow tubes 57 are guided to the outside from the top surface of the cover main body 301, 302.

Further, in the present embodiment, the relative positions between the tip parts (the refrigerant inflow port connection end parts to be inserted into the joints 70SL, 70SR) of the refrigerant relay pipes 65SL, 65SR and the tip parts (the liquid inflow port connection end parts to be inserted into the base joints 80SL, 80SR) of the ink relay pipes 66SL, 66SR in the cover unit 401A are substantially the same as the relative positions between the tip parts of the refrigerant relay pipes 65SL, 65SR and the tip parts of the ink relay pipes 66SL, 66SR in the cover unit 401B. Therefore, it is possible to easily perform the replacing work between the cover unit 401A and the cover unit 401B to the main body part 400. Similarly, the relative positions between the tip parts (refrigerant outflow port connection end parts to be inserted into the joints 70EL, 70ER) of the refrigerant relay pipes 65EL, 65ER and the tip parts (refrigerant outflow port connection end parts to be inserted into the base joints 80EL, 80ER) of the ink relay pipes 66EL, 66ER in the cover unit 402A are substantially the same as the relative positions between the tip parts of the refrigerant relay pipes 65EL, 65ER and the tip parts of the ink relay pipes 66EL, 66ER in the cover unit 402B. Therefore, it is possible to easily perform the replacing work between the cover unit 402A and the cover unit 402B to the main body part 400.

2. Other Modified Examples

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head and the head chip, but those described in the above embodiment and so on are not limitations, and it is possible to adopt other shapes, arrangements, numbers and so on.

Specifically, although the two cooling sections 404L, 404R, for example, are disposed in the inkjet head 4 in the embodiment described above, it is also possible to adopt a configuration having just one cooling section, or three or more cooling sections in the present disclosure.

Further, although the configuration of jetting one color of ink from one inkjet head 4 is described in the above embodiment, it is also possible to adopt a configuration of jetting two colors of ink from one inkjet head 4 in the present disclosure. Specifically, two sets of the ink tank 3, the ink supply tube 51, the pressure pump 51P, the ink discharge tube 52 and the suction pump 52P are provided. Then, one of the ink tanks 3 is connected to the ink inflow tube 56L via one of the ink supply tubes 51 and one of the pressure pumps 51P, and the other of the ink tanks 3 is connected to the ink inflow tube 56R via the other of the ink supply tubes 51 and the other of the pressure pumps 51P. Further, the ink outflow tube 57L is connected to the one of the ink tanks 3 via one of the ink discharge tubes 52 and one of the suction pumps 52P, and the ink outflow tube 57R is connected to the other of the ink tanks 3 via the other of the ink discharge tubes 52 and the other of the suction pumps 52P. By adopting this configuration, it is possible to independently supply the ink to the ink inflow tube 56L and the ink inflow tube 56R. Therefore, by making the color of the ink different between the two ink tanks 3, it is possible to supply the ink inflow tube 56R with the ink different in color from the ink to be supplied to the ink inflow tube 56L.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head 4) of the present disclosure is applied to other devices than the inkjet printer. Specifically, for example, it is also possible to arrange that the "liquid jet head" of the present disclosure is applied to a device such as a facsimile or an on-demand printer.

It should be noted that the advantages described in the specification are illustrative only but are not a limitation, and another advantage can also be provided.

The present disclosure may be embodied as described below.

<1>

A liquid jet head comprising a main body part having a liquid jet head chip including a liquid flow channel through which a liquid passes, and adapted to jet the liquid; and a cooling section including a refrigerant flow channel through which a refrigerant passes; an inflow side connection unit configured so as to be selectively attached to and detached from the main body part on an upstream side in the liquid flow channel and an upstream side in the refrigerant flow channel; and an outflow side connection unit configured so as to be selectively attached to and detached from the main body part on a downstream side in the liquid flow channel and a downstream side in the refrigerant flow channel, wherein a first inflow side cover unit including a liquid inflow tube branched into a liquid relay path connectable to a liquid inflow port of the liquid flow channel and a refrigerant relay path connectable to a refrigerant inflow port of the refrigerant flow channel, and a second inflow side cover unit separately including a liquid inflow tube connected to the liquid relay path connectable to the liquid inflow port and a refrigerant inflow tube connected to the refrigerant relay path connectable to the refrigerant inflow port of the refrigerant flow channel are selectable as the inflow side connection unit, and a first outflow side cover unit including a liquid outflow tube where a liquid relay path connectable to a liquid outflow port of the liquid flow channel and a refrigerant relay path connectable to a refrigerant outflow port of the refrigerant flow channel are merged with each other, and a second outflow side cover unit separately including a liquid outflow tube connected to the liquid relay path connectable to the liquid outflow port and a refrigerant outflow tube connected to the refrigerant relay path connectable to the refrigerant outflow port of the refrigerant flow channel are selectable as the outflow side connection unit.

<2>

The liquid jet head according to <1>, wherein the cooling section has a cooling pipe adapted to form the refrigerant flow channel, and a cooling plate having contact with an outer surface of the cooling pipe, the cooling pipe is made of a corrosion-resistant material having corrosion resistance to the liquid, and the cooling plate is made of a highly heat-conductive material having higher thermal conductivity than thermal conductivity of the corrosion-resistant material.

<3>

The liquid jet head according to <2>, wherein the corrosion-resistant material is stainless steel, and the highly heat-conductive material is one of an aluminum simple substance and an aluminum alloy.

<4>

The liquid jet head according to any one of <1> to <3>, wherein the refrigerant flow channel is installed so that a height position of the refrigerant inflow port is lower than a height position of the refrigerant outflow port.

<5>

The liquid jet head according to any one of <1> to <4>, further comprising an elastic connection member having a ring-like shape, provided to at least one of the liquid inflow port, the refrigerant inflow port, the liquid outflow port and the refrigerant outflow port in the main body part, and including an insertion port in which one of a liquid inflow connection end part of the liquid relay path, a refrigerant inflow connection end part of the refrigerant relay path, a liquid outflow connection end part of the liquid relay path and a refrigerant outflow connection end part of the refrigerant relay path is inserted, wherein the elastic connection member has an inside end part located on the main body side, and an outside end part located on an opposite side to the main body part, and in a state in which the inflow side connection unit and the outflow side connection unit are detached, an outside diameter of one of the liquid inflow connection end part, the refrigerant inflow connection end part, the liquid outflow connection end part and the refrigerant outflow connection end part to be inserted to the insertion port is larger than an inside diameter of the inside end part of the elastic connection member, and is smaller than an inside diameter of the outside end part of the elastic connection member.

<6>

The liquid jet head according to <5>, wherein the outside end part of the elastic connection member includes a thick wall part, and a thin wall part located inside the thick wall part.

<7>

The liquid jet head according to <5> or <6>, wherein the inside end part of the elastic connection member is a duckbill valve.

<8>

The liquid jet head according to any one of <1> to <7>, wherein the first inflow side cover unit, the second inflow side cover unit, the first outflow side cover unit and the second outflow side cover unit each have a cover main body, and the liquid inflow tube and the liquid outflow tube are guided from an inside of the cover main body to an outside of the cover main body through a side surface of the cover main body.

<9>

The liquid jet head according to any one of <1> to <8>, wherein a relative position between a liquid inflow port connection end part of the liquid relay path to the liquid inflow port and a refrigerant inflow port connection end part of the refrigerant relay path to the refrigerant inflow port in the first inflow side cover unit is substantially the same as a relative position between a liquid inflow port connection end part of the liquid relay path to the liquid inflow port and a refrigerant inflow port connection end part of the refrigerant relay path to the refrigerant inflow port in the second inflow side cover unit.

<10>

The liquid jet head according to any one of <1> to <9>, wherein a relative position between a liquid outflow port connection end part of the liquid relay path to the liquid outflow port and a refrigerant outflow port connection end part of the refrigerant relay path to the refrigerant outflow port in the first outflow side cover unit is substantially the same as a relative position between a liquid outflow port connection end part of the liquid relay path to the liquid outflow port and a refrigerant outflow port connection end part of the refrigerant relay path to the refrigerant outflow port in the second outflow side cover unit.

<11>

A liquid jet recording device comprising the liquid jet head according to any one of <1> to <10>; and a carriage to which the liquid jet head is attached.

What is claimed is:

1. A liquid jet head comprising:

a main body part having:

a liquid jet head chip including a liquid flow channel through which a liquid passes, and adapted to jet the liquid; and a cooling section including a refrigerant flow channel through which a refrigerant passes;

an inflow side connection unit configured so as to be selectively attached to and detached from the main body part on an upstream side in the liquid flow channel and an upstream side in the refrigerant flow channel; and an outflow side connection unit configured so as to be selectively attached to and detached from the main body part on a downstream side in the liquid flow channel and a downstream side in the refrigerant flow channel, wherein a first inflow side cover unit including a liquid inflow tube branched into a liquid relay path connectable to a liquid inflow port of the liquid flow channel via a liquid inflow joint and a refrigerant relay path connectable to a refrigerant inflow port of the refrigerant flow channel via an refrigerant inflow joint, and a second inflow side cover unit separately including a liquid inflow tube connected to the liquid relay path connectable to the liquid inflow port via the liquid inflow joint and a refrigerant inflow tube connected to the refrigerant relay path connectable to the refrigerant inflow port of the refrigerant flow channel via the refrigerant inflow joint are selectable as the inflow side connection unit, and a first outflow side cover unit including a liquid outflow tube where a liquid relay path connectable to a liquid outflow port of the liquid flow channel via a liquid outflow joint and a refrigerant relay path connectable to a refrigerant outflow port of the refrigerant flow channel via a refrigerant outflow joint are merged with each other, and a second outflow side cover unit separately including a liquid outflow tube connected to the liquid relay path connectable to the liquid outflow port via the liquid outflow joint and a refrigerant outflow tube connected to the refrigerant relay path connectable to the refrigerant outflow port of the refrigerant flow channel via the refrigerant outflow joint.

2. The liquid jet head according to claim 1, wherein the cooling section has a cooling pipe adapted to form the refrigerant flow channel, and a cooling plate having contact with an outer surface of the cooling pipe, the cooling pipe is made of a corrosion-resistant material having corrosion resistance to the liquid, and the cooling plate is made of a highly heat-conductive material having higher thermal conductivity than thermal conductivity of the corrosion-resistant material.

3. The liquid jet head according to claim 2, wherein the corrosion-resistant material is stainless steel, and the highly heat-conductive material is one of an aluminum simple substance and an aluminum alloy.

4. The liquid jet head according to claim 1, wherein the refrigerant flow channel is installed so that a height position of the refrigerant inflow port is lower than a height position of the refrigerant outflow port.

5. The liquid jet head according to claim 1, wherein at least one of the inflow and outflow joints further comprises:

an elastic connection member having a ring-like shape, provided to at least one of the liquid inflow port, the refrigerant inflow port, the liquid outflow port and the refrigerant outflow port in the main body part, and including an insertion port in which one of a liquid inflow connection end part of the liquid relay path, a refrigerant inflow connection end part of the refrigerant relay path, a liquid outflow connection end part of the liquid relay path and a refrigerant outflow connection end part of the refrigerant relay path is inserted, wherein the elastic connection member has an inside end part located on the main body side, and an outside end part located on an opposite side to the main body part, and in a state in which the inflow side connection unit and the outflow side connection unit are detached, an outside diameter of one of the liquid inflow connection end part, the refrigerant inflow connection end part, the liquid outflow connection end part and the refrigerant outflow connection end part to be inserted to the insertion port is larger than an inside diameter of the inside end part of the elastic connection member, and is smaller than an inside diameter of the outside end part of the elastic connection member.

6. The liquid jet head according to claim 5, wherein the outside end part of the elastic connection member includes a thick wall part, and a thin wall part located inside the thick wall part.

7. The liquid jet head according to claim 5, wherein the inside end part of the elastic connection member is a duckbill valve.

8. The liquid jet head according to claim 1, wherein the first inflow side cover unit, the second inflow side cover unit, the first outflow side cover unit and the second outflow side cover unit each have a cover main body, and the liquid inflow tube and the liquid outflow tube are guided from an inside of the cover main body to an outside of the cover main body through a side surface of the cover main body.

9. The liquid jet head according to claim 1, wherein a relative position between a liquid inflow port connection end part of the liquid relay path to the liquid inflow port and a refrigerant inflow port connection end part of the refrigerant relay path to the refrigerant inflow port in the first inflow side cover unit is substantially the same as a relative position between a liquid inflow port connection end part of the liquid relay path to the liquid inflow port and a refrigerant inflow port connection end part of the refrigerant relay path to the refrigerant inflow port in the second inflow side cover unit.

10. The liquid jet head according to claim 1, wherein a relative position between a liquid outflow port connection end part of the liquid relay path to the liquid outflow port and a refrigerant outflow port connection end part of the refrigerant relay path to the refrigerant outflow port in the first outflow side cover unit is substantially the same as a relative position between a liquid outflow port connection end part of the liquid relay path to the liquid outflow port and a refrigerant outflow port connection end part of the refrigerant relay path to the refrigerant outflow port in the second outflow side cover unit.

11. A liquid jet recording device comprising:

the liquid jet head according to claim 1; and a carriage to which the liquid jet head is attached.

* * * * *